US007166403B2

(12) United States Patent
Ichikawa et al.

(10) Patent No.: US 7,166,403 B2
(45) Date of Patent: Jan. 23, 2007

(54) TONER, DEVELOPER, IMAGE DEVELOPING APPARATUS, AND IMAGE FORMING APPARATUS

(75) Inventors: Tomoyuki Ichikawa, Numazu (JP); Satoshi Mochizuki, Numazu (JP); Yasuaki Iwamoto, Numazu (JP); Hideki Sugiura, Fuji (JP); Tadao Takikawa, Kyoto (JP); Toshihiko Kinsho, Kyoto (JP); Hidetoshi Noda, Kyoto (JP); Shuhei Yahiro, Kyoto (JP)

(73) Assignee: Ricoh Company, Ltd., Tokyo (JP)

( * ) Notice: Subject to any disclaimer, the term of this patent is extended or adjusted under 35 U.S.C. 154(b) by 27 days.

(21) Appl. No.: 11/165,361

(22) Filed: Jun. 24, 2005

(65) Prior Publication Data

US 2005/0255399 A1 Nov. 17, 2005

Related U.S. Application Data

(63) Continuation of application No. PCT/JP04/10019, filed on Jul. 14, 2004.

(30) Foreign Application Priority Data

Jul. 14, 2003 (JP) ..... 2003-196315

(51) Int. Cl.
*G03G 9/00* (2006.01)

(52) U.S. Cl. ..... 430/110.3; 430/109.4; 399/252

(58) Field of Classification Search ..... 430/110.3, 430/109.4; 399/252
See application file for complete search history.

(56) References Cited

U.S. PATENT DOCUMENTS 6,497,984 B2 * 12/2002 Itami et al. ..... 430/125

FOREIGN PATENT DOCUMENTS

| | | |
|---|---|---|
| JP | 9-179411 | 7/1997 |
| JP | 2000-75538 | 3/2000 |
| JP | 2000-122347 | 4/2000 |
| JP | 2000-267331 | 9/2000 |
| JP | 2001-312191 | 11/2001 |
| JP | 2002-23408 | 1/2002 |
| JP | 2002-108019 | 4/2002 |
| JP | 2002-287400 | 10/2002 |
| JP | 2002-311775 | 10/2002 |
| JP | 2003-91100 | 3/2003 |
| JP | 2003-107783 | 4/2003 |

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A toner capable of making compatible a transferring property, a fixing property and a cleaning property and forming a high-precision image. The toner comprises a binder resin and a colorant and is characterized in that the average circularity of the toner is at least 0.95, a ratio (D/S) between the total projection area (S) and the contact area (D) of the toner is 15% to 40%, and the contact area (D) is a total contact area between the toner and an object surface. The toner has such a shape as to be able to contact a latent image carrier with a proper contact area, has a high transferring rate and can prevent transferring dust.

21 Claims, 5 Drawing Sheets

TONER, DEVELOPER, IMAGE DEVELOPING APPARATUS, AND IMAGE FORMING APPARATUS

BACKGROUND OF THE INVENTION

1. Field of the Invention

The present invention relates to a toner and a developer used for forming an image in an electrostatic copying process, such as for a copier, a facsimile, and a printer. The present invention further relates to an image developing apparatus and an image forming apparatus in which the developer is used.

2. Description of the Related Art

An image forming process according to an electrophotographic process comprises a charging step for giving an electric charge to the surface of an photoconductor, which is a latent image carrier, by means of an electric discharge; an exposing step for exposing the charged surface of the photoconductor to form a latent electrostatic image; a developing step for supplying a toner to the latent electrostatic image formed on the surface of the photoconductor to develop a toner image; a transferring step for transferring the toner image on the surface of the photoconductor onto the surface of a transfer material; a fixing step for fixing the toner image on the surface of the transfer material; and a cleaning step for eliminating the residual toner remaining on the surface of the photoconductor after the transferring. In recent years, there has been increasingly demands for higher quality images, and in particular, to realize forming a high-precision color image, toner's smaller sizing (namely smaller diameter of toner particle) and toner's conglobation (rounded spherical form) are under way. Toner's smaller sizing enables excellent dot-reproductivity, and toner's conglobation makes it possible to improve developing properties and transferring properties. Since it is very difficult to manufacture such a smaller-particle-sized and conglobated toner by a conventional kneading and grinding method, there is a growing adoption of a polymerized toner manufactured by a suspension polymerization method, an emulsion polymerization method, and a dispersion polymerization method.

However, if a toner particle diameter is sized down up to a few micrometers or less, non-electrostatic adherence, such as, van der Waals force or the like which works on between the toner and a photoconductor increases in proportion to its weight empty, and therefore, mold-release properties become degraded, which affects transferring properties and cleaningability, and the like.

On the other hand, since a toner which is conglobated and formed in a shape close to a perfect sphere has a lower adherence with photoconductors or the like than that of a toner in indefinite (undetermined) forms obtained by a kneading and grinding method, a higher transfer rate can be obtained because the conglobated toner has excellent mold-release properties. Besides, the conglobated toner makes an image transfer true to a latent image along the line of electric force, because the toner particles also have a low adherence each other and therefore the toner is susceptible to the line of electric force. However, when a transfer material is released from a photoconductor, a high electric field is induced between the photoconductor and the transfer material (burst phenomenon), which causes a problem that the toner on the transfer material and the photoconductor is scattered and toner dust occurs on the transfer material.

If a toner formed in a shape close to a perfect sphere is in a condition where the toner just has been transferred onto a transferring paper but not yet fixed, there is a problem that the toner is liable to roll by contact with a fixing member in a fixing step, which causes a disordered image, since such toner particles has a low adherence each to each, as stated above.

Further, a toner formed in a shape close to a perfect sphere has a problem that it is hard to be cleaned by blade cleaning which has been used so far. This is because a conglobated toner is liable to roll on the surface of a photoconductor and the toner slips through a clearance between the photoconductor and a cleaning blade.

For the reasons mentioned above, it becomes a new challenge to control a surface shape of a toner so as to be able to properly give an adherence between a toner and a photoconductor or an adherence among toner particles while providing a toner design in consideration of toner's smaller sizing and conglobation. There have been various proposals presented so far for controlling a toner's surface shape of its smaller sizing and conglobation particularly with a view to improving cleaningability. For example, there is a proposal in which through the use of SF-1 (shape factor-1) which is an indicator representing the level of roundness (sphericity) of a toner particle and SF-2 (shape factor-2) which is an indicator representing the level of concave and convex of a toner particle to represent a toner shape, improvements in cleaningability are performed by defining one shape factor of SF-1 or SF-2 or both shape factors to control a toner's shape (for example, see Japanese Patent Application Laid-Open (JP-A) Nos. 2000-122347, 2000-267331, 2001-312191, 2002-23408, 2002-311775, and 09-179411).

However, there may be cases where with improved cleaningability, it becomes difficult to make a toner have such a shape that a balance between favorable transferring properties and fixability can be achieved. There is no toner presented in which toner's surface shape is considered and examined from the perspective of improvements in not only cleaningability but also transferring properties and fixability.

SUMMARY OF THE INVENTION

In the light of the above mentioned problems, it is an object of the present invention to provide a toner which enables achieving a balance between transferring properties, fixability, and cleaningability and enables forming a high-precision image.

To solve the above mentioned problems, as a result of keen examinations provided by the inventors of the present invention, it is found that it is possible to form a high-quality image by controlling the surface shape of a toner so as to set an adherence between the toner and individual members in each step of an image forming process in an appropriate range and by using the toner which properly contact with the individual members.

The units to solve the above mentioned problems are as follows.

<1> A toner for developing an electrostatic image which comprises a binder resin and a colorant, wherein the toner has an average circularity of 0.95 or more and a ratio of the total contact area of the toner "D" to the total projection area of the toner "S" being 15% to 40%, and the total contact area of the toner "D" is the total area of contact surface portions between the toner and an object surface.

<2> The toner for developing an electrostatic image according to the item <1>, wherein the total contact area of the toner "D" is defined as the total area of contact surface areas between the toner and a glass plane plate when the toner being dropped and placed on the horizontally kept glass plane plate from above a height of 10 cm of the glass plane plate while sieving the toner through a sieve of 22 μm mesh for 10 seconds.

<3> The toner for developing an electrostatic image according to the item <2>, wherein the toner has a ratio "L/M," a long axis to a minor axis of a contact surface portion between the toner and the glass plane plate, satisfying a relation of "L/M>3" in at least one contact surface portion.

<4> The toner for developing an electrostatic image according to the item <1>, wherein the total contact area of the toner "D" is the total area of the contact surface portions between the toner and a latent image carrier "A", and the toner has a ratio "D/S", the total contact area of the toner "D" to the total projection area of the toner "S", being a ratio "A/S", the total area of the contact surface portions between the toner and the latent image carrier "A" to the total projection area of the toner "S".

<5> The toner for developing an electrostatic image according to the item <4>, wherein the toner has a ratio "L/M", a long axis to a minor axis of a contact surface portion between the toner and a latent image carrier, satisfying a relation of "L/M>3" in at least one contact surface portion.

<6> The toner for developing an electrostatic image according to the item <1>, wherein the total contact area of the toner "D" is the total area of the contact surface portions between the toner and an intermediate transferring member "B", and the toner has a ratio "D/S", the total contact area of the toner "D" to the total projection area of the toner "S", being a ratio "B/S", the total area of the contact surface portions between the toner and the intermediate transferring member "B" to the total projection area of the toner "S".

<7> The toner for developing an electrostatic image according to the item <6>, wherein the toner has a ratio "L/M," a long axis to a minor axis of a contact surface portion between the toner and the intermediate transferring member, satisfying a relation of "L/M>3" in at least one contact surface portion.

<8> The toner for developing an electrostatic image according to the item <1>, wherein the total contact area of the toner "D" is the total area of the contact surface portions between the toner and a fixing member "C", and the toner has a ratio "D/S", the total contact area of the toner "D" to the total projection area of the toner "S", being a ratio "C/S", the total area of the contact surface portions between the toner and the fixing member "C" to the total projection area of the toner "S".

<9> The toner for developing an electrostatic image according to the item <8>, wherein the toner has a ratio "L/M," a long axis to a minor axis of a contact surface portion between the toner and the fixing member, satisfying a relation of "L/M>3" in at least one contact surface portion.

<10> The toner for developing an electrostatic image according to the item <1>, wherein the toner has a shape factor value of SF-2 of 120 to 150.

<11> The toner for developing an electrostatic image according to the item <1>, wherein the toner has a volume mean diameter "Dv" of 3.0 μm to 8.0 μm and a ratio "Dv/Dn" of the volume mean diameter "Dv" to a number mean diameter "Dn" of 1.00 to 1.30.

<12> The toner for developing an electrostatic image according to the item <1>, wherein the toner has a 20% or less toner particle content with a particle diameter corresponding to a circle being 2.0 μm or less on a number basis.

<13> The toner for developing an electrostatic image according to the item <1>, wherein the binder resin comprises a modified polyester "i".

<14> The toner for developing an electrostatic image according to the item <13>, wherein the binder resin further comprises an unmodified polyester "ii" and has a weight-to-weight ratio of the modified polyester "i" to the unmodified polyester "ii" of 5:95 to 80:20.

<15> The toner for developing an electrostatic image according to the item <13>, wherein the toner can be obtained by carrying out a cross-linking reaction and/or an elongation reaction of a dispersion liquid of toner materials in which a polyester prepolymer having at least a nitrogen functional group, a polyester, a colorant, a releasant, an inorganic filler are dispersed in an organic solvent, in an aqueous medium.

<16> A two-component developer which comprises a toner for developing an electrostatic image, and carrier particles which comprises magnetic particles, wherein the toner for developing an electrostatic image is a toner which comprises a binder resin and a colorant, wherein the toner has an average circularity of 0.95 or more and a ratio "D/S", of the total contact area of the toner "D" to the total projection area of the toner "S" being 15% to 40%, and the total contact area of the toner "D" is the total area of contact surface portions between the toner and an object surface.

<17> A one-component developer which comprises a toner for developing an electrostatic image, wherein the toner for developing an electrostatic image is a toner which comprises a binder resin and a colorant, wherein the toner has an average circularity of 0.95 or more and a ratio "D/S", of the total contact area of the toner "D" to the total projection area of the toner "S" being 15% to 40%, and the total contact area of the toner "D" is the total area of contact surface portions between the toner and an object surface.

<18> An image developing apparatus which comprises a developer, a developer carrier, and a latent image carrier, wherein the developer is carried and transported by the developer carrier to a position opposed to the latent image carrier to form an electric field and to develop a latent electrostatic image on the latent image carrier, wherein the developer is a toner which comprises a binder resin and a colorant, and the toner has an average circularity of 0.95 or more and a ratio "D/S", of the total contact area of the toner "D" to the total projection area of the toner "S" being 15% to 40%, and the total contact area of the toner "D" is the total area of contact surface portions between the toner and an object surface.

<19> A process cartridge which comprises a latent image carrier, and a developing unit, wherein the developing unit comprises a developer and is configured to supply the developer to a latent image formed on a surface of the latent image carrier to develop the image into a visible image, the latent image carrier and the developing unit are to be formed in a single body and mounted to the main body of an image forming apparatus in an attachable and detachable fashion, the developing unit is an image developing apparatus in which a developer is carried and transported by a developer carrier to form a magnetic field in a position opposed to the latent image carrier and to develop a latent electrostatic image on the latent image carrier, and wherein the developer comprises a toner which comprises a binder resin and a colorant, and the toner has an average circularity of 0.95 or more and a ratio "D/S", of the total contact area of the toner "D" to the total projection area of the toner "S" being 15% to 40%, and the total contact area of the toner "D" is the total area of contact surface portions between the toner and an object surface.

<20> An image forming apparatus which comprises a latent image carrier which carries a latent image, a charging unit configured to uniformly charge a surface of the latent image carrier, an exposing unit configured to expose the charged surface of the latent image carrier based on image data to write a latent electrostatic image on the latent image carrier, a developing unit configured to supply a toner to the latent electrostatic image formed on the surface of the latent image carrier to develop the image into a visible image, a transferring unit configured to transfer the visible image on the surface of the latent image carrier to a transfer material, and a fixing unit configured to fix the visible image on the transfer material, wherein the developing unit is an image developing apparatus in which a developer is carried and transported by a developer carrier to form a magnetic field in a position opposed to the latent image carrier and to develop a latent electrostatic image on the latent image carrier, the developer is a toner which comprises a binder resin and a colorant, and the toner has an average circularity of 0.95 or more and a ratio "D/S", of the total contact area of the toner "D" to the total projection area of the toner "S" being 15% to 40%, and the total contact area of the toner "D" is the total area of contact surface portions between the toner and an object surface.

<21> A process for forming an image which comprises charging a surface of a latent image carrier uniformly, exposing the charged surface of the latent image carrier based on image data to write a latent electrostatic image on the latent image carrier, supplying a toner to the latent electrostatic image formed on the surface of the latent image carrier to develop the image into a visible image, transferring the visible image on the surface of the latent image carrier to a transfer material, and fixing the visible image on the transfer material, wherein the toner is a toner which comprises a binder resin and a colorant, and the toner has an average circularity of 0.95 or more and a ratio "D/S", of the total contact area of the toner "D" to the total projection area of the toner "S" being 15% to 40%, and the total contact area of the toner "D" is the total area of contact surface portions between the toner and an object surface.

DESCRIPTION OF THE PREFERRED EMBODIMENTS

Hereafter, aspects of the present invention will be explained below.

The present invention is a toner used for forming an image through the use of an electrophotographic process, the toner comprises a binder resin and a colorant, and the average circularity of the toner is 0.95 or more.

The average circularity of the toner is a value obtained by optically detecting toner particles, and the circumferential length of a circle which has an area equivalent to the projection area of the toner is divided by a circumferential length of an actual toner particle. Specifically, the average circularity of the toner is measured using a flow particle image analyzer (FPIA-2000; manufactured by Sysmex Corp.). To a given vessel, 100 ml to 150 ml of water with impure solid matters preliminarily removed is placed, 0.1 ml to 0.5 ml of a surfactant is added as a dispersant, and about 0.1 g to 9.5 g of a sample of a toner is further added. The suspension with the sample dispersed therein was subjected to a dispersion for about 1 minute to 3 minutes using an ultrasonic dispersing apparatus to make a concentration of the dispersant 3,000 No. of pcs./μL to 10,000 No. of pcs./μL to measure the shape and distribution of the toner.

The toner of the present invention has an average circularity of 0.95 or more, the shape of the projected toner is close to a circle, the toner excels in dot reproductivity and enables obtaining a high transferring rate. If the average circularity is less than 0.95, the toner becomes to have a non-spherical shape, dot reproductivity of the toner becomes degraded, and since the number of contacts points between a latent image carrier and a photoconductor become increased, mold-release properties become degraded, which causes a lowered transferring rate.

Figure 1:
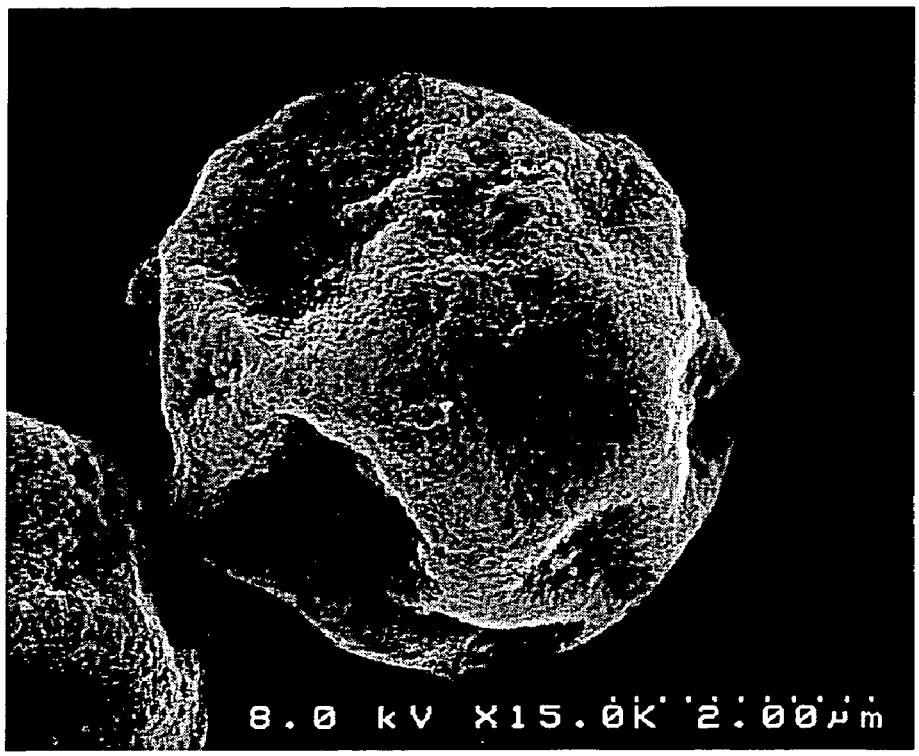
FIG. 1 is an electron photomicrograph showing an example of a shape of the toner according to the present invention.

In addition, the toner of the present invention has moderate concaves and convexes on the surface. As mentioned above, a spherically shaped toner having a low adherence between the toner and a latent image carrier or a low adherence between the toner particles each to each can make it possible to obtain a high transferring rate, but at the same time such a toner caused problems with occurrences of transferring dust and degradation of cleaningability. Accordingly, it is preferred that the surface of a toner is not smoothly formed and has concaves and convexes so as to properly contact a latent image carrier. FIG. 1 is an electron photomicrograph showing an example of a shape of the toner of the present invention.

The toner of the present invention is a toner in which a ratio (D/S) of the total contact area of the toner (D) to the total projection area of the toner (S) is ranging from 15% to 40%. Here, the contact area (D) represents a contact surface area between the toner and an object surface. When there are two or more contact surfaces (contact surface portions), the contact area (D) represents the total contact area of the contact surface portions.

The toner of the present invention is a toner in which a ratio (A/S) of the total contact area between the toner and a latent image carrier (A) to the total projection area of the toner (S) is ranging from 15% to 40% as a percentage.

The toner of the present invention is a toner in which a ratio (B/S) of the total contact area between the toner and an intermediate transferring member (B) to the total projection area of the toner (S) is ranging from 15% to 40% as a percentage.

In addition, the toner of the present invention is a toner in which a ratio (C/S) of the total contact area between the toner and a fixing member (C) to the total projection area of the toner (S) is ranging from 15% to 40% as a percentage.

The method of measuring these values of A/S, B/S, and C/S is as follows:

First, a glass plane plate (for example, a standard transparent slide glass (thickness: 2 mm)) which is used to resemble a pseudo latent image carrier, a pseudo intermediate transferring member, a pseudo fixing member, is prepared, and a sieve of 22 μm mesh is set on the glass plate. The toner is placed on the sieve and the toner was sieved from above a height of 10 cm while vibrating the sieve for 10 seconds to uniformly put a little amount of the toner on the glass plate through the mesh. A photo of the glass plane plate held in this state is taken from the bottom of the glass plate using a high-definition digital camera (COOL PIX 5000 4,920,000 pixels: manufactured by NICON). The image taken at that time is an image that makes it possible to discern between the portion that the toner contacts the glass plate surface and the portion that the toner does not contact the glass plate surface. The image picture is scanned into a personal computer to perform an image analysis using an image analyzer (Image-Pro Plus: manufactured by Planetron, Inc.). The area in which the toner contacts the glass plate surface is blacked out, and the area is defined as "D" (as a pseudo, A, B or C) to obtain the area. The outline of the whole toner is drawn with black, and the entire area surrounded with the black line is defined as "S" to obtain the area. Finally, a value of D/S (as a pseudo, A/S, B/S or C/S) can be obtained using the above mentioned values. The above noted image processing is performed as to 100 or more sampling toners.

The reason a glass plane plate is used as a pseudo latent image carrier, a pseudo intermediate transferring member, and a pseudo fixing member that when comparing a radius of a toner particle, a curvature radius of an actually used photoconductor, a curvature radius of an intermediate transferring member, and a curvature radius of a fixing member, a surface of these individual members with which a toner have contact can be made closely resemble a plane surface, even if these members are formed in any one of shapes of a drum, a belt, and a roller.

The value of D/S, A/S, B/S, and C/S being 15% to 40% means that the toner has such a shape that the toner can contact a latent image carrier, an intermediate transferring member, and a fixing member with a proper contact area.

When the value of A/S is less than 15%, it is impossible to prevent transferring dust and to improve cleaningability, because the contact between the toner and a latent image carrier is in an insufficient condition. When the value of A/S is more than 40%, mold-release properties become degraded, and this may cause degradation of its transferring rate, because an adherence between the toner and a latent image carrier becomes increased.

When the value of B/S is less than 15%, transferring dust is liable to occur at the time of secondary transferring onto a transferring paper, because the contact between the toner and an intermediate transferring member is in an insufficient condition. When the value of B/S is more than 40%, mold-release properties become degraded, and this may cause degradation of a secondary transferring rate, because an adherence between the toner and an intermediate transferring member becomes increased.

When the value of C/S is less than 15%, when starting a fixing step, not-fixed toner may roll on the transferring paper, and this may cause an image defect, because the contact between the not-fixed toner on the transferring paper and a fixing member, such as a fixing roller, is in an insufficient condition. On the other hand, when the value of C/S is more than 40%, the fixed toner image becomes an image with the reproductivity of a thin line being insufficient, because the contact area between the toner and a fixing member becomes increased, and the toner is liable to spread over a transferring paper.

It is preferable that the toner of the present invention has line-contact with individual members of a latent image carrier, an intermediate transferring member, and a fixing member. Namely, this means a condition where a value of A/S, B/S, and C/S is 15% to 40%, as described above, and such a state lies midway between point-contact (the value becomes less than 15%) and area-contact (the value becomes more than 40%), and it indicates a condition of contact in which a number of continuous point-contact points continue into a line (a condition that a number of continuous point-contact points appear to be a line).

Specifically, the condition of line-contact implies that a ratio (L/M) of a long axis (L) to a minor axis (M) satisfies the relation of (L/M)>3 in at least one contact surface portion of the contact areas between the toner of the present invention and a glass plane plate which is used to resemble a latent image carrier, an intermediate transferring member, and a fixing member. The shape of the toner varies in some degree depending on individual toner particles, but it is preferable that at least over half the toner particles satisfy the relation of (L/M)>3 at least in one contact surface portion of the contact areas between the toner particles and a glass plane plate, and it is more preferably that 70% or more of the toner particles satisfy the relation of (L/M)>3 at least in one contact surface portion of the contact areas between the toner particles and a glass plane plate.

Figure 2:
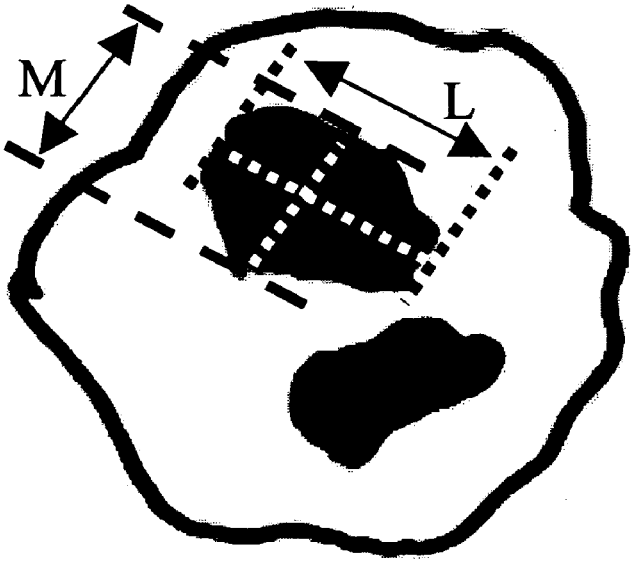
FIG. 2 is a view schematically showing a long axis L and a minor axis M of the contact surface between the toner and a glass plane plate.

FIG. 2 is a view schematically showing a long axis (L) and a minor axis (M) of the contact area between the toner particles and a glass plane plate. The value of L/M is calculated from the long axis (L) and the minor axis (M) of the contact area between the toner particles and the glass plane plate.

In the present invention, a long axis (L) denotes the longest straight line among the lines which reside from one point in the outline of a contact surface between the toner and an object surface to another one point farthest from the one point in the outline of the contact surface.

A minor axis (M) denotes the longest straight line among the lines which reside from one point in the outline of the contact surface to another one point farthest from the one point in the outline of the contact surface which exists on a straight line perpendicular to the long axis (L) which passes the one point.

Figure 3A:
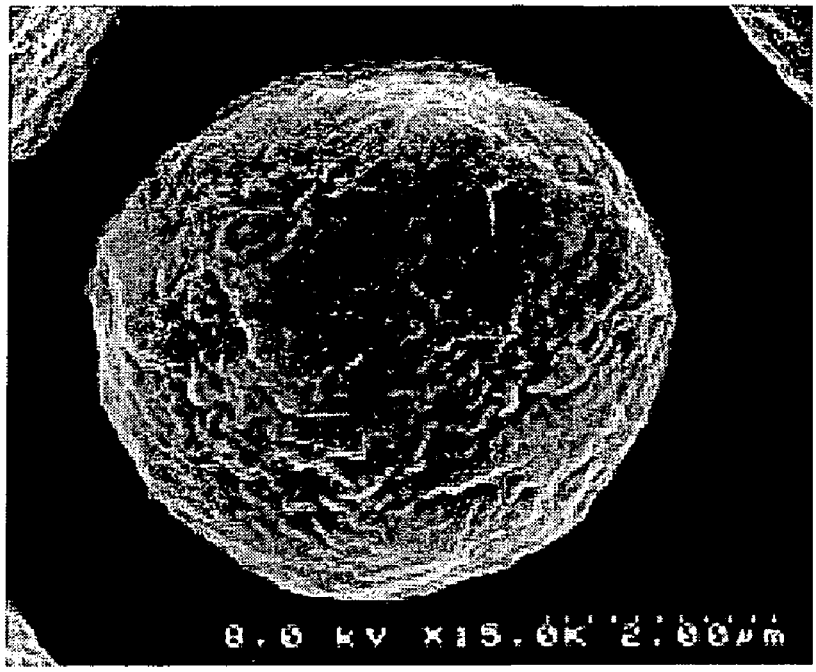
FIG. 3A is a view schematically showing the way a generally spherical toner particle contacts a glass plane plate.
Figure 3A:
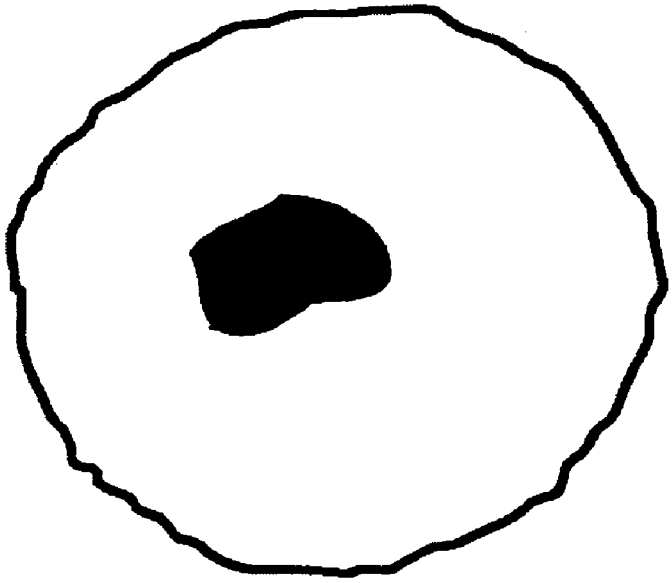
Figure 3B:
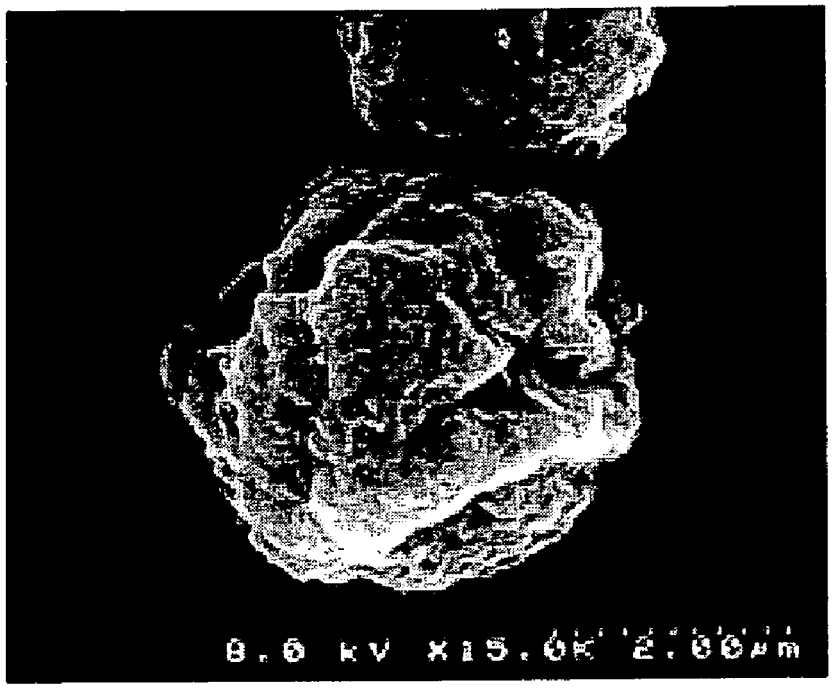
FIG. 3B is a view schematically showing the way a toner particle according to the present invention contacts a glass plane plate.
Figure 3B:
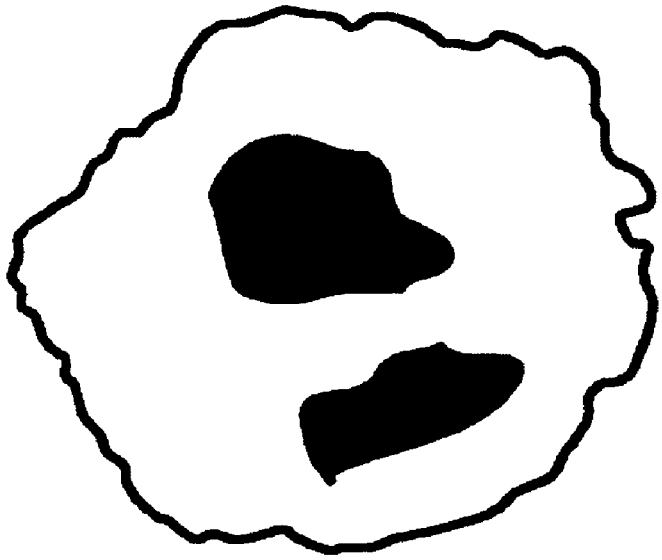
Figure 3C:
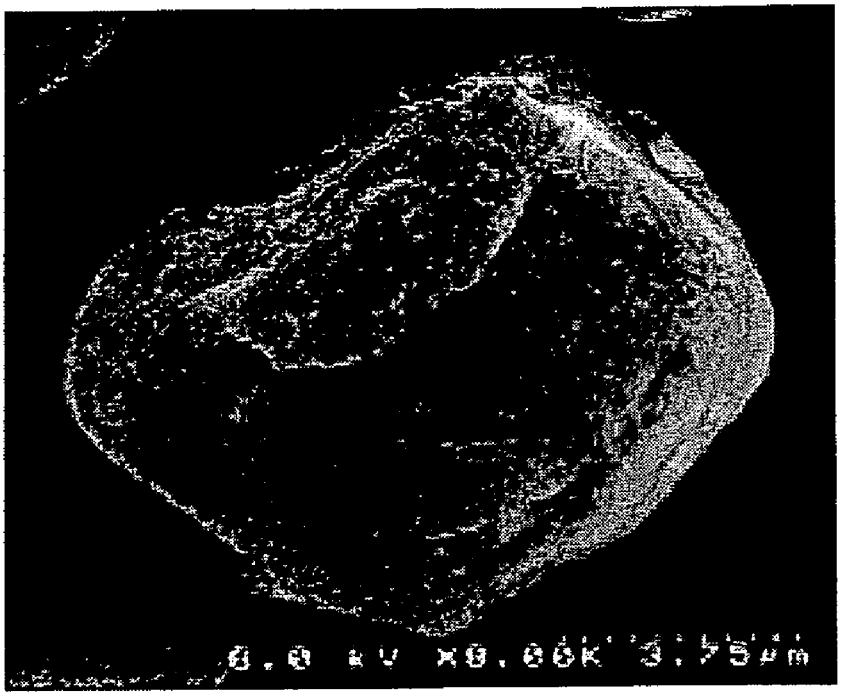
FIG. 3C is a view schematically showing the way an indefinite (undetermined) toner particle obtained by a kneading and grinding method contacts a glass plane plate.
Figure 3C:
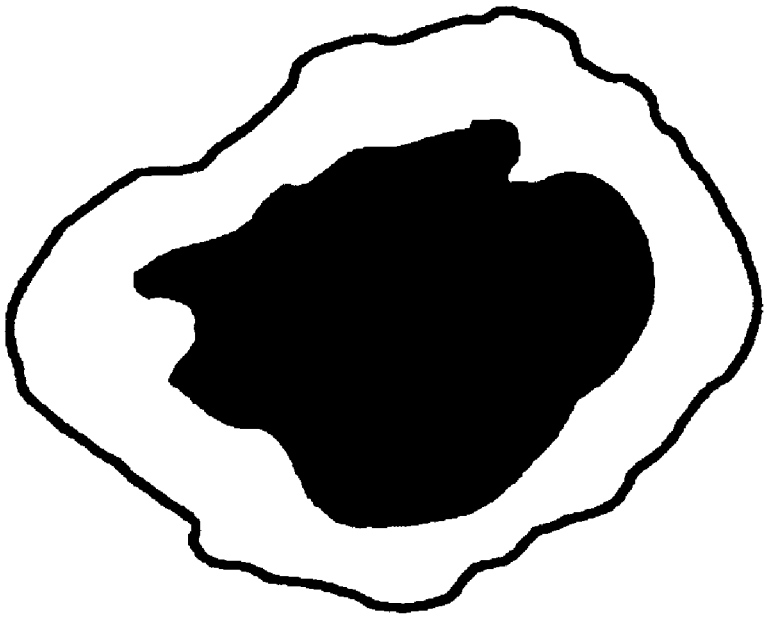

FIG. 3A to FIG. 3C are views schematically showing the ways each toner differently contacts a glass plane plate depending on the shape of toner. In these views, each contact area of the toners put on a glass plane plate is blacked out. FIG. 3A shows a toner being nearly spherical in shape shape, and since the toner has a shape with less concaves and convexes formed on the surface, it is in a condition close to point-contact with the glass plane plate. FIG. 3C shows an indefinite (undetermined) toner obtained by a kneading and grinding method and has area-contact with a glass plane plate. When a toner and a glass plane plate are in close to point-contact condition, as seen in FIG. 3A, the contact area between the toner and the other part of member is small. For instance, when the other part of member is a latent image carrier or an intermediate transferring member, a high transferring rate can be obtained because the toner has excellent mold-release properties. However, on the other hand, the adherence between the toner and the other part of member is small, and then it may cause transferring dust and degradation of cleaningability. When starting a fixing step, not-fixed toner may roll on a transferring paper, and this may cause an image defect, because the contact between the not-fixed toner on a transferring paper and a fixing is in an insufficient condition.

When a toner has area-contact with a glass plane plate, as seen in FIG. 3C, the contact area between the toner and the other part of member is large. For instance, when the other part of member is a latent image carrier, the transferring rate becomes lower, because the toner's mold-release properties to the latent image carrier are poor. At the same time, transferring dust and scattered toner may be easily cleaned depending on the cleaning blade, because the toner's adherence to the latent image carrier is large.

On the other hand, according to the toner of the present invention, as shown FIG. 3B, the contact area between the toner and a glass plane plate is in line-contact condition where a number of continuous point-contact points continue into a line (such continuous point-contact points look like a line), and the toner is in a state where at least one contact area satisfying a relation between the long axis L and the minor axis M of (L/M)>3 is included. If the contact between a toner and a latent image carrier is in line-contact condition so that at least one contact surface portion thereof satisfies a relation of (L/M)>3, a high transferring rate can be obtained, because the adherence between the toner and a latent image carrier does not become so strong, and the toner shows proper mold-release properties to a latent image carrier. Besides, it is possible to prevent transferring dust and improve cleaningability, since rolling of the toner can be restrained on a latent image carrier, and proper contact among toner particles can be obtained. With an intermediate transferring member, it is possible that the toner has proper mold-release properties and shows a high secondary transferring rate and prevent transferring dust with a proper adherence. In addition, in a fixing step, proper contact condition with a fixing member, such as, a fixing roller enables stopping any image defects caused by toner rolling, and it is possible to obtain a high-quality fixed image in which a toner densely aggregated, because toner particles having an average circularity of 0.95 or more have proper adherences each other.

In addition, the toner of the present invention preferably has a value of shape factor SF-2 ranging from 120 to 150. The shape factor SF-2 indicates a degree of concaves and convexes of toner shape. A toner picture is taken by a scanning electron microscope (S-800: manufactured by HITACHI, Ltd.) and the picture is analyzed by an image analyzer (LUSEX3: manufactured by NIRECO Corp.) to calculate the shape factor SF-2. Specifically, as shown in the following equation I, a value of the shape factor SF-2 is the one that a squared-value of a peripheral length (PERI) of the figure which can be formed by projecting a toner onto a two-dimensional plane is divided by the figure area (AREA) and then multiplied by $100\pi/4$.

$$SF\text{-}2=\{(\mathrm{PERI})2/\mathrm{AREA}\}\times(100\pi/4) \qquad \text{equation I}$$

When the value of SF-2 is less than 120, there are not many concaves and convexes on the surface of a toner, and a sufficient contact area between the toner and a latent image carrier cannot be obtained. The greater the value of SF-2 becomes, the more conspicuous concaves and convexes of the toner shape becomes, and when the SF-2 value is more than 150, it is not preferable because it leads to degradation of image quality by concaves and convexes on the surface of the toner, such as a toner transfer true to a latent image is not performed in a transferring step.

Further, the toner of the present invention preferably has a volume mean diameter (Dv) of 3.0 μm to 8.0 μm and a ratio (Dv/Dn) of a volume mean diameter (Dv) to a number mean diameter (Dn) is 1.00 to 1.30. By forming a toner having such a particle diameter and particle diameter distribution, it is possible that the toner excels in any of heat resistant storage properties, low-temperature image fixing properties, and particularly when used in a full-color copier, excellent gloss properties can be obtained in an image.

Generally, it is said that the smaller a toner particle is, it becomes more advantageous in obtaining a high-resolution and high-quality image, but at the same time, it is disadvantageous in terms of a transferring rate and cleaningability. When a volume mean diameter is smaller than the minimum diameter of the present invention, and when used as a two-component developer, the toner fuses on the surface of magnetic carriers in a long hours of stirring in an image developing apparatus, and it makes charging abilities of the magnetic carriers lowered, and when used as a one-component developer, toner-filming to a developing roller and toner fusion onto a member, such as, a blade, for making a toner have a thin layer, are liable to occur.

On the other, when a toner volume mean diameter is greater than the maximum diameter of the present invention, it becomes harder to obtain a high-resolution and high quality image, and it is often the case that toner particle diameter largely varies when toner inflow/outflow being performed in a developer.

When Dv/Dn is more than 1.30, it is not preferable because distribution of an amount of charge becomes broader, and resolution also becomes degraded.

The average particle diameter and the particle size distribution of a toner can be measured using Coulter Counter TA-II, and Coulter Multi-sizer II (both manufactured by Beckman Coulter, Inc.). In the present invention, the average particle diameter and the particle size distribution was measured by using Coulter Counter TA-II model and by connecting it to an interface (manufactured by The Institute of Japanese Union of Scientists & Engineers) and a personal computer (PC9801: manufactured by NEC) which outputs a number distribution and a volume distribution.

It is preferable that the toner has a 20% toner particle content with a particle diameter corresponding to a circle being 2.0 μm or less, so called, fine particle content of the toner, on a number basis. When the fine particle content of the toner is more than 20%, when used in a two-component developer, such a toner may adhere to magnetic carriers, and it becomes impossible to keep charging stability at a high level. It is not preferred because such a toner causes toner scattering and background smears, which are numerous number of black points printed on a white media.

Here, the measurements of a toner particle diameter corresponding to a circle and the toner particle content with a toner particle diameter corresponding to a circle being 2.0 μm or less on a number basis can be performed using a flow particle image analyzer (FPIA-1000; manufactured by SYSMEX Corp.). The apparatus and the outline of the measurements are described in Japanese Patent Application Laid-Open (JP-A) No. 08-136439. An aqueous solution containing 1% NaCl was prepared using primary sodium chloride, and the aqueous solution was strained through a filter (0.45 μm). To 50 ml to 100 ml of the strained liquid, a surfactant, preferably 0.1 ml to 5 ml of an alkylbenzene sulphonate was added as a dispersant, followed by addition of 1 mg to 10 mg of a toner sample. The liquid was subjected to a dispersion process for one minute through the use of an ultrasonic dispersing apparatus. The measurement of the number of toner particles was performed by using the dispersion liquid in which the particle density was controlled to 5000 No. of pcs./μm to 15,000 No. of pcs./μm. The measurement of the number of toner particles was performed based on the following calculation. A diameter of a circle which had the same area as that of a two-dimensional toner particle image taken by a CCD camera was defined as the particle diameter corresponding to a circle. Based on the precision of the CCD's pixel, a diameter corresponding to a circle of 0.6 μm or more was determined as valid, and the measurement data of toner particles was obtained.

Examples of the toner of the present invention includes the ones prepared by using the following components.

(Modified Polyester)

The toner of the present invention comprises a modified polyester (i) as a binder resin. A modified polyester indicates a state of a polyester in which a combined group other than ester bond may reside in a polyester resin, and different resin components are combined into a polyester resin through covalent bond, ionic bond or the like. Specifically, a modified polyester is the one that a functional group, such as, an isocyanate group or the like which reacts to a carboxylic acid group and a hydrogen group, is introduced to a polyester end and further reacted to an active hydrogen-containing compound to modify the polyester end.

Examples of the modified polyester (i) include a urea modified polyester which is obtained by a reaction between a polyester prepolymer (A) having an isocyanate group and amines (B). Examples of the polyester prepolymer (A) having an isocyanate group include a polyester prepolymer which is a polycondensation polyester of a polyvalent alcohol (PO) and a polyvalent carboxylic acid (PC) and having an active hydrogen group is further reacted to a polyvalent isocyanate compound (PIC). Examples of the active hydrogen group included into the above-noted polyester include a hydroxyl group (an alcoholic hydroxyl group and a phenolic hydroxyl group), an amino group, a carboxyl group, and a mercapto group. Among these groups, an alcoholic hydroxyl group is preferable.

A urea polyester is formed in the following manner.

Examples of the polyvalent alcohol compound (PO) include a divalent alcohol (DIO), and a trivalent or more polyvalent alcohol (TO), and any of a divalent alcohol (DIO) alone and a mixture of a divalent alcohol (DIO) with a small amount of a polyvalent alcohol (TO) are preferable. Examples of the divalent alcohol (DIO) include an alkylene glycol (such as, ethylene glycol, 1,2-propylene glycol, 1,3-propylene glycol, 1,4-bytandiol, and 1,6-hexanediol); an alkylene ether glycol (such as, diethylene glycol, triethylene glycol, dipropylene glycol, polyethylene glycol, polypropylene glycol, and polytetramethylene ether glycol); an alicyclic diol (such as, 1,4-cyclohexane dimethanol, and hydrogenated bisphenol A); bisphenols (such as, bispheonol A, bisphenol F, and bisphenol S); an alkylene oxide adduct of the above-noted alicyclic diol (such as, an ethylene oxide, a propylene oxide, and a butylene oxide); and an alkylene oxide adduct of the above-noted bisphenols (such as, an ethylene oxide, a propylene oxide, and a butylene oxide). Among the above mentioned, an alkylene glycol having carbon number 2 to 12 and an alkylene oxide adduct of bisphenols are preferable, and an alkylene oxide adduct of bisphenols and a combination of the adduct with an alkylene glycol having carbon number 2 to 12 are particularly preferable. Examples of the trivalent or more polyvalent alcohol (TO) include a polyaliphatic alcohol of trivalent to octavalent or more (such as, glycerine, trimethylol ethane, trimethylol propane, pentaerythritol, and sorbitol); and trivalent or more phenols (such as, trisphenol PA, phenol novolac, and cresol novolac); and alkylene oxide adduct of the trivalent or more polyphenols.

Examples of the polyvalent carboxylic acid (PC) include a divalent carboxylic acid (DIC) and a trivalent or more polyvalent carboxylic acid (TC), and any of a divalent carboxylic acid (DIC) alone and a mixture of a divalent carboxylic acid (DIC) with a small amount of a polyvalent carboxylic acid (TC) are preferable. Examples of the divalent carboxylic acid (DIC) include an alkylene dicarboxylic acid (such as, succinic acid, adipic acid, and sebacic acid); an alkenylen dicarboxylic acid (such as, maleic acid, and fumaric acid); an aromatic dicarboxylic acid (such as, phthalic acid, isophthalic acid, terephthalic acid, and naphthalene dicarboxylic acid). Among these divalent carboxylic acids, an alkenylen dicarboxylic acid having carbon number 4 to 20 and an aromatic dicarboxylic acid having carbon number 8 to 20 are preferable. Examples of the trivalent or more polyvalent carboxylic acid (TC) include an aromatic polyvalent carboxylic acid having carbon number 9 to 20 (such as, trimellitic acid, and pyromellitic acid). It is noted that as a polyvalent carboxylic acid (PC), an acid anhydride from among the polyvalent carboxylic acids or a lower alkyl ester (such as, methyl ester, ethyl ester, and isopropyl ester) may be used to react to a polyvalent alcohol (PO).

A ratio of a polyvalent alcohol (PO) to a polyvalent carboxylic acid (PC), defined as an equivalent ratio [OH]/[COOH] of a hydroxyl group [OH] to a carboxyl group [COOH], is typically 2/1 to 1/1, preferably 1.5/1 to 1/1, and more preferably 1.3/1 to 1.02/1.

Examples of the polyvalent isocyanate compound (PIC) include an aliphatic polyvalent isocyanate (such as, tetramethylen diisocyanate, hexamethylen diisocyanate, and 2,6-diisocyanate methyl caproate); an alicyclic polyisocyanate (such as, isophorone diisocyanate, and cyclohexyl methane diisocyanate); an aromatic diisocyanate (such as, tolylene diisocyanate, and diphenylmethane diisocyanate); an aromatic aliphatic diisocyanate (α,α,α',α'-tetramethyl xylylene diisocyanate, and the like); isocyanates; a compound in which the above noted polyisocyanate is blocked with a phenol derivative, an oxime, caprolactam, and the like; and a combination of two or more elements thereof.

A ratio of a polyvalent isocyanate compound (PIC), defined as an equivalent ratio [NCO]/[OH] of an isocyanate group [NCO] to a hydroxyl group [OH] of a polyester having a hydroxyl group, is typically 5/1 to 1/1, preferably 4/1 to 1.2/1, and more preferably 2.5/1 to 1.5/1. When [NCO]/[OH] is more than 5, low-temperature image fixing properties becomes degraded. When the molar ratio of [NCO] is less than 1, when a urea modified polyester is used, the urea content of ester becomes lower, which makes hot-offset resistivity becomes degraded.

The components content of polyvalent isocyanate compound (PIC) of a polyester prepolymer having an isocyanate group (A) is typically 0.5 wt % to 40 wt %, preferably 1 wt % to 30 wt %, and more preferably 2 wt % to 20 wt %. When less than 0.5 wt %, it makes hot-offset resistivity degraded and brings about disadvantages in the compatibility between heat resistant storage properties and low-temperature image fixing properties. On the other hand, when it is more than 40 wt %, low-temperature image fixing properties become degraded. The number of isocyanate groups contained in per one molecular of polyester prepolymer having isocyanate group (A) is typically 1 or more, preferably 1.5 to 3 on an average, and more preferably 1.8 to 2.5 on an average. When the number of isocyanate groups is less than 1 per 1 molecular of polyester prepolymer, the molecular weight of the urea modified polyester becomes lower, which makes hot-offset resistivity degraded.

Next, examples of amines (B) to be reacted to a polyester prepolymer (A) include a divalent amine compound (B1), a trivalent or more polyvalent amine compound (B2), an aminoalcohol (B3), an amino mercaptan (B4), an amino acid (B5), and an compound in which the amino group of B1 to B5 is blocked (B6).

Examples of the divalent amine compound (B1) include an aromatic diamine (such as, phenylene diamine, diethyl toluene diamine, 4,4'-diamino diphenyl methane); an alicyclic diamine(4,4'-diamino-3,3'-dimethyl dicyclohexyl methane, diamine cyclohexane, and isophorone diamine); and an aliphatic diamine (such as, ethylene diamine, tetramethylene diamine, and hexamethylene diamine). Examples of the trivalent or more polyvalent amine compound (B2) include diethylene triamine, and triethylene tetramine. Examples of the aminoalcohol (B3) include ethanol amine, and hydroxyethylaniline. Examples of the amino mercaptan (B4) include aminoethyl mercaptan, and aminopropyl mercaptan. Examples of the amino acid (B5) include aminopropionic acid, aminocaproic acid, and the like. Examples of the compound in which the amino group of B1 to B5 is blocked (B6) include a ketimine compound obtained from the above-noted amines of B1 to B5 and ketones (such as, acetone, methyl ethyl ketone, and mehyl isobuthyl ketone) and oxazolidine compound, and the like. Among these amines (B), a divalent amine compound B1 and a mixture of B1 with a small amount of a trivalent or more polyvalent amine compound (B2) are preferable.

A ratio of amines (B), defined as an equivalent ratio [NCO]/[NHx] of isocyanate group [NCO] in a polyester prepolymer having isocyanate group (A) to amine group [NHx] in amines (B), is typically 1/2 to 2/1, preferably 1.5/1 to 1/1.5, and more preferably 1.2/1 to 1/1.2. When [NCO]/[NHx] is more than 2 or less than 1/2, the molecular weight of urea modified polyester becomes lower, which makes hot-offset resistivity degraded.

In addition, the urea modified polyester may include a urethane bond as well as a urea bond. A molar ratio of the urea bond content to the urethane bond content is typically 100/0 to 10/90, preferably 80/20 to 20/80, and more preferably 60/40 to 30/70. When a molar ratio of the urea bond is less than 10%, hot-offset resistivity becomes degraded.

A modified polyester (i) used in the present invention is manufactured by one-shot method, and prepolymer method. The weight average molecular weight of the modified polyester (i) is typically 10,000 or more, preferably 20,000 to 10,000,000 and more preferably 30,000 to 1,000,000. The molecular weight peak at the time is preferably 1,000 to 10,000, and when less than 1,000, it is hard to be subjected to elongation reactions, and the toner's elasticity is low, which makes hot-offset resistivity become degraded. When the molecular weight peak is more than 10,000, it may cause degradation of fixability and may bring hard challenges in manufacturing in yielding toner's fine particles and in toner grinding. The number average molecular weight of the modified polyester (i) when used together with an unmodified polyester (ii), which will be hereafter described, is not particularly limited, and it may be a number average molecular weight which is easily obtained to be used with the above-noted weight average molecular weight. When a modified polyester (i) is used alone, the number average molecular weight is typically 20,000 or less, preferably 1,000 to 10,000, and more preferably 2,000 to 8,000. When the number average molecular weight is more than 20,000, low-temperature image fixing properties and gross properties when used in a full-color device become degraded.

In cross-linking and/or elongation reactions of a polyester prepolymer (A) and amines (B) in order to obtain a modified polyester (i), a reaction stopper may be used as required to control the molecular weight of a urea modified polyester to be obtained. Examples of the reaction stopper include a monoamine (such as, diethyl amine, dibutyl amine, buthyl amine, and lauryl amine), and a compound in which the above-noted elements are blocked.

It is noted that the molecular weight of a polymer to be formed can be measured by means of gel permeation chromatography (GPC), using a tetrahydrofuran (THF) solvent.

(Unmodified Polyester)

In the present invention, not only the modified polyester (i) may be used alone but also an unmodified polyester (ii) may be included together with the modified polyester (i) as binder resin components. Using an unmodified polyester (ii) in combination with a modified polyester (i) is preferable to the use of the modified polyester (i) alone, because low-temperature image fixing properties and gloss properties when used in a full-color device become improved. Examples of the unmodified polyester (ii) include a polycondensation polyester of a polyvalent alcohol (PO) and a polyvalent carboxylic acid (PC), and the like, same as in the modified polyester (i) components. Preferable compounds thereof are also the same as in the modified polyester (i). As for the unmodified polyester (ii), in addition to an unmodified polyester, it may be a polymer which is modified by a chemical bond other than urea bonds, for example, it may be modified by a urethane bond. It is preferable that at least part of a modified polyester (i) is compatible with part of an unmodified polyester (ii), from the aspect of low-temperature image fixing properties and hot-offset resistivity. Thus, it is preferable that the composition of the modified polyester (i) is similar to that of the unmodified polyester (ii). A weight ratio of a modified polyester (i) to an unmodified polyester (ii) when an unmodified polyester (ii) being included, is typically 5/95 to 80/20, preferably 5/95 to 30/70, more preferably 5/95 to 25/75, and still more preferably 7/93 to 20/80. When the weight ratio of a modified polyester (i) is less than 5%, it makes hot-offset resistivity degraded and brings about disadvantages in compatibility between heat resistant storage properties and low-temperature image fixing properties.

The molecular weight peak of the unmodified polyester (ii) is typically 1,000 to 10,000, preferably 2,000 to 8,000, and more preferably 2,000 to 5,000. When the molecular weigh peak of the unmodified polyester (ii) is less than 1,000, heat resistant storage properties becomes degraded, and when more than 10,000, low-temperature image fixing properties becomes degraded. The hydroxyl value of the unmodified polyester (ii) is preferably 5 or more, more preferably 10 to 120, and still more preferably 20 to 80. When the value is less than 5, it brings about disadvantages in the compatibility between heat resistant storage properties and low-temperature image fixing properties. The acid number of the unmodified polyester (ii) is preferably 1 to 5, and more preferably 2 to 4. Since a wax with a high acid value is used, as for a binder, a binder with a low acid value is easily matched with a toner used in a two-component developer, because such a binder leads to charging and a high volume resistivity.

The glass transition temperature (Tg) of the binder resin is typically 35° C. to 70° C., and preferably 55° C. to 65° C. When less than 35° C., toner's heat resistant storage properties becomes degraded, and when more than 70° C., low-temperature image fixing properties becomes insufficient. The toner of the present invention shows a proper heat resistant storage properties tendency even with a low glass transition temperature, compared to a toner made from a polyester known in the art, because a urea modified polyester easily exists on the surface of particles of the toner base to be obtained. It is noted that the glass transition temperature (Tg) can be measured using a differential scanning calorimeter (DSC).

(Colorant)

With respect to the colorant to be used, all the dyes and pigments known in the art may be used. For example, it is possible to use carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthraene yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridon red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS, BC), indigo, ultramarine, iron blue, anthraquinon blue, fast violet B, methylviolet lake, cobalt purple, manganese Violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone, and a mixture thereof. The colorant content of the toner is typically 1 weight % to 15 weight %, and preferably 3 weight % to 10 weight %.

The colorant may be used as a masterbatch compounded with a resin. Examples of the binder resin to be used in manufacturing of a masterbatch, or to be kneaded with a masterbatch include a styrene such as, polystyrene, poly-p-chlorostyrene, polyvinyl toluene, and a derivative substitution polymer thereof, or a copolymer of the above-noted styrene and a vinyl compound, polymethyl methacrylate, polybutyl methacrylate, polyvinylchloride, polyvinyl acetate, polyethylene, polypropylene, polyester, an epoxy resin, an epoxy polyol resin, polyurethane, polyamide, polyvinyl butyral, a polyacrylic acid resin, rodin, a modified-rodin, a terpene resin, an aliphatic hydrocarbon resin, an alicyclic hydrocarbon resin, an aromatic petroleum resin, chlorinated paraffin, and paraffin wax. Each of these colorants may be employed alone or in combination of two or more.

The masterbatch may be obtained by applying a high shearing force to a resin and a colorant for masterbatch and by mixing and kneading the components. Here, to improve the interaction between the resin and the colorant, an organic solvent can be used. Besides, a so-called flashing process is preferably used in manufacturing a mater batch, because in the flashing process, a wet cake of a colorant can be directly used without the necessity of drying. In the flashing process, a colorant's water paste containing water is mixed and kneaded with a resin and an organic solvent to transfer the colorant to the resin and then to remove the moisture and the organic solvent component. For mixing or kneading as above, a high shearing dispersion device such as a triple roll mill is preferably used.

(Charge Controlling Agent)

As a charge controlling agent, a conventional one in the art can be used. Examples of the charge controlling agent include a nigrosine dye, a triphenylmethane dye, a chrome-contained metal-complex dye, a molybdic acid chelate pigment, a rhodamine dye, an alkoxy amine, a quaternary ammonium salt (including a fluoride-modified quaternary ammonium salt), an alkylamide, a phosphoric simple substance or a compound thereof, a tungsten simple substance or a compound thereof, a fluoride activator, a salicylic acid metallic salt, and a salicylic acid derivative metallic salt. Specifically, Bontron 03 being a nigrosine dye, Bontron P-51 being a quaternary ammonium salt, Bontron S-34 being a metal containing azo dye, Bontron E-82 being an oxynaphthoic acid metal complex, Bontron E-84 being a salicylic acid metal complrex, and Bontron E-89 being a phenol condensate (manufactured by Orient Chemical Industries, Ltd.); TP-302 and TP-415 being a quaternary ammonium salt molybdenum metal complex (manufactured by HODOGAYA CHEMICAL CO., LTD.); Copy Charge PSY VP2038 being a quaternary ammonium salt, Copy Blue PR being a triphenylmethane derivative, and Copy Charge NEG VP2036 and Copy Charge NX VP434 being a quaternary ammonium salt (manufactured by Hoechst Ltd.); LRA-901, and LR-147 being a boron metal complex (manufactured by Japan Carlit Co., Ltd.), copper phtalocyamine, perylene, quinacridone, an azo pigment, and other high-molecular weight compounds having a functional group, such as a sulfonic acid group, a carboxyl group, and a quaternary ammonium salt. Among the charge controlling agents, a substance capable of controlling a toner to a negative polarity is preferably used.

The usage of the charge controlling agent is determined depending on the type of a binder resin, presence or absence of an additive to be used as required, and the method for manufacturing a toner including a dispersion process and is not limited uniformly, however, to 100 parts by weight of binder resin, 0.1 parts by weight to 10 parts by weight of the charge controlling agent is preferably used and more preferably with 0.2 parts by weight to 5 parts by weight of the charge controlling agent. When the charge controlling agent is more than 10 parts by weight, toner's charge properties are exceedingly large, which lessens the effect of the charge controlling agent itself and increases in electrostatic attraction force with a developing roller, and causes degradations of developer's fluidity and image density.

(Releasant)

A wax having a melting point of 50° C. to 120° C. which is dispersed in a binder resin is more effectively works on the phase boundary between a fixing roller and a toner as a releasant in a dispersion liquid with a binder resin dispersed therein, which exert effect on high temperature offsets without any applications of a releasant like a oil to a fixing roller. The wax components are as follows. Examples of the wax include a wax of vegetable origin, such as, carnauba wax, cotton wax, sumac wax, and rice wax; a wax of animal origin, such as, beeswax, and lanoline, and a wax of mineral origin, such as, ozokerite, and ceresin, and a petroleum wax, such as, paraffin, micro crystalline, and petrolatum. Besides the above-noted permanent waxes, there are a hydrocarbon synthetic wax, such as, a Fischer-Tropsch wax, polyethylene wax; and a synthetic wax, such as, ester wax, ketone wax, and ether wax. Further, it is also possible to use a polyacrylate homopolymer, such as, poly-n-stearyl methacrylate, and poly-n-lauril methacrylate being a fatty acid and a low-molecular-weight crystalline polymer resin, such as, 12-hydroxy stearic acid amide, stearic acid amide, phthalic anhydride imide, and chlorinated hydrocarbon or a copolymer (such as, a n-stearyl acrylate-ethylmethacrylate copolymer, and the like); and a crystalline polymer having a long alkyl group in its side chain (such as, a n-stearylacrylate-ethylmethacrylate copolymer).

The above-noted charge controlling agents and the releasants may be fused and kneaded with a masterbatch and a binder resin and may be surely added when dissolved and dispersed into an organic solvent.

(External Additives)

As an external additive for assisting in fluidity of toner particles, developing properties, and charge properties, inorganic particles are preferably used. A first-order particle diameter of the inorganic particles is preferably $5\times10^{-3}$ μm to 2 μm and more preferably $5\times10^{-3}$ μm to 0.5 μm. A specific surface according to BET equation is preferably 20 $m^2/g$ to 500 $m^2/g$. A proportion of the usage of the organic particles is preferably 0.01 weight % to 5 weight % of the toner amount and more preferably 0.01 weight % to 2.0 weight % of the toner amount. Specifically, examples of the inorganic particles include silica, alumina, a titanium oxide, barium titanate, magnesium titanate, calcium titanate, strontium titanate, a zinc oxide, a tin oxide, silica sand, clay, mica, wallastonite, silious earth, a chromium oxide, a ceric oxide, colcothar, an antimony trioxide, a magnesium oxide, a zirconium oxide, barium sulfate, barium carbonate, calcium carbonate, silicon carbide, and silicon nitride.

Besides the above-mentioned, polymer particles, such as, polymer particles made from a polystyrene copolymer, a methacrylic acid ester copolymer, and an acrylic acid ester copolymer obtained by a soap-free emulsion polymerization, a suspension polymerization, and a dispersion polymerization; and condensation polymers such as silicon, benzoguanamine, and nylon, and a thermosetting resin.

The external additives stated above enable preventing deteriorations of toner's fluidity and charge properties even under high-humidity environment by performing surface finishing thereof to improve hydrophobic properties. Examples of preferable finishing agents include a silane coupling agent, a sililation reagent, a silane coupling agent having a fluorinated alkyl group, an organic titanate coupling agent, an aluminum coupling agent, silicon oil, and a modified silicon oil. Particularly, it is preferable to use hydrophobic silica and a hydrophobic titanium oxide obtained by performing the above-noted surface finishing on silica and a titanium oxide.

Next, a method for manufacturing a toner will be described. Here, a preferred example of the method will be explained; however, it is not limited to the disclosed method.

(Method for Manufacturing a Toner Binder)

A toner binder may be manufactured by the following method, and the like. A polyvalent alcohol (PO) and a polyvalent carboxylic acid (PC) are heated to a temperature of 150° C. to 280° C. in the presence of an esterification catalyst known in the art, such as, tetrabutoxy titanate, and a dibutyltin oxide, and yielded water was removed while depressurizing as needed to obtain a polyester having a hydroxyl group. Next, the obtained polyester is reacted to a polyisocyanate compound (PIC) at a temperature of 40° C. to 140° C. to obtain a prepolymer having an isocyanate group (A). Further, the prepolymer (A) is reacted to amines (B) at a temperature of 0° C. to 140° C. to obtain a modified polyester with urea bond.

On the occasion of reacting a polyisocyanate compound (PIC) and the occasion of reacting the prepolymer (A) to amines (B), a solvent may be used if needed. Examples of available solvents include a solvent which is inactive to a polyisocyanate compound (PIC), such as, an aromatic solvent (such as, toluene, and xylene); a ketone (such as, acetone, methyl ethyl ketone, and methyl isobutyl ketone); an ester (such as, ethyl acetate); an amide (such as, dimethylformamide, and dimethylacetamide); and ether (such as, tetrahydrofuran).

When an unmodified polyester (ii) is used in combination with the modified polyester, an unmodified polyester (ii) is manufactured in a similar manner as the polyester having a hydroxyl acid group, and the obtained polyester is melted into a solvent which has been subjected to the reactions as in the modified polyester and then mixed.

(Method for Manufacturing a Toner)

1) A colorant, an unmodified polyester (i), a polyester prepolymer having an isocyanate group (A), a releasant, and inorganic filler are dispersed into an organic solvent to prepare a toner materials-contained solution.

As to the organic solvent, an organic solvent being volatile with a boiling point of 100° C. or less is preferable in terms of ease of removability after toner base particles being formed. Specifically, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone and the like may be used alone or in combination with two or more. Particularly, an aromatic solvent, such as, toluene, xylene, and a halogenated hydrocarbon, such as, 1,2-dichloroethane, chloroform, carbon tetrachloride, are preferable. The usage of the organic solvent to 100 parts by weight of the polyester prepolymer is typically 1 part by weight to 300 parts by weight, preferably 1 part by weight to 100 parts by weight, and more preferably 25 part by weight to 70 parts by weight.

The inorganic filler exists near the surface of the toner base particles to assume the roll of controlling a shape of the toner base particles in the course of manufacturing.

Examples of preferable inorganic fillers include a metal oxide, such as, a silica, a diatom earth, an alumina, a zinc oxide, titania, zirconia, a calcium oxide, a magnesium oxide, an iron oxide, a copper oxide, a tin oxide, a chromium oxide, an antimony oxide, an yttrium oxide, a cerium oxide, a samarium oxide, a lanthanum oxide, a tantalum oxide, a terbium oxide, an europium oxide, a neodymium oxide, and a ferrite; a metal hydroxide, such as, a calcium hydroxide, a magnesium hydroxide, an aluminum hydroxide, and a basic magnesium carbonate; a metal carbonate, such as, heavy calcium carbonate, light calcium carbonate, zinc carbonate, barium carbonate, dawsonite, hydrotalcite; a metal sulfate, such as, calcium sulfate, barium sulfate, and plaster fiber; a metal silicate, such as, calcium silicate (wollastonite, xonotlite), kaolin, clay, talc, mica, montmorillonite, bentonite, active terra alba, sepiolite, imogorite, sericite, a glass fiber, a glass beads, a glass flake; a metal nitride, such as, aluminum nitride, borate nitride, and silicon nitride; a metal titanate, such as, potassium titanate, calcium titanate, magnesium titanate, barium titanate, and lead zirconate titanium aluminum borate; a metal borate, such as, zinc borate, and aluminum borate; a metal phosphate, such as, tricalcium phosphate; a metal sulfide, such as, molybdenum sulfide; a metal carbide, such as, silicon carbide, carbons, such as, carbon black, graphite, and a carbon fiber; and other fillers. Among the above inorganic fillers, silica, alumina, and titania are preferable.

To disperse an inorganic filler into an organic solvent, it is proper that the inorganic filler is used in an organosol configuration as stated below. To obtain an organosol of the inorganic filler, for example, there is a process in which a dispersion liquid of the inorganic filler synthesized by a wet process (such as, a hydrothermal synthesis method, and a sol-gel process) is hydrophobized using a finishing agent to replace the water by an organic solvent, such as, a methyl ethyl ketone, and an ethyl acetate.

Examples of the finishing agent include a silicon oil, a coupling agent (for example, a silane coupling agent, a titanate coupling agent, and an aluminate coupling agent), an amine compound, and various commercially available pigment dispersants. Among these finishing agents, silicone oil, a silane coupling agent, and an amine compound is preferably used.

Examples of the silicon oil include a straight silicon oil, such as, dimethyl silicon oil, methyl phenyl silicon oil, methyl hydrogen silicon oil; and a modified silicon oil, such as, methacrylic acid modified silicon oil, epoxy modified silicon oil, fluoride modified silicon oil, polyether modified silicon oil, and amino modified silicon oil. Examples of the silane coupling agent include organoalkoxy silane, organochlor silane, organosilazane, organodisilazane, organosiloxane, organo disiloxane, and organosilane.

As for the amine compound, it is possible to use a compound which is compatible with an organic solvent and has any one or more of a primary amine group, a secondary amine group, and a tertiary group, however, it is preferable to use a compound having a tertiary group in which no active hydrogen is contained, because there is a possibility that an amine compound reacts with a polyester prepolymer. Examples of such a tertiary compound include triethyl amine, N,N'-dimethylamino diethyl ether, tetramethyl hexamethylene diamine, tetramethylethylene diamine, dimethylethanol amine, N-methyl-N'-(2-dimethylamino)ethylpiperazine, 1,2-dimethylimidazole, triethylene diamine, N, N, N', N", N"-pentamethyl diethylene triamine, N, N, N', N", N"-pentamethyl dipropylene triamine, tetramethyl guanidine, 1,8-diazabicyclo[5,4,0]undecen-7, and bis(2-morpholino ethyl)ether. These tertiary compounds may be used in combination with two or more. Among these compounds, triethylamine, 1,8-diazabicyclo[5,4,0]undecen-7, and bis(2-morpholino ethyl)ether are particularly preferable.

With respect to a method for manufacturing an organosol of an inorganic filler, for instance, the method described in Japanese Paten Application Laid-Open (JP-A) No. 11-43319 may be used. Examples of the commercially available organosol include Organo Silica Sol MEK-ST, and a MEK-ST-UP (manufactured by NISSAN CHEMICAL INDUSTRIES, LTD.).

The particle diameter of the inorganic filler is preferably 5 nm to 100 nm, and more preferably 10 nm to 30 nm. The amount of addition of the inorganic filler to 100 parts by weight of toner's resin components (including binder components, and wax components as a releasant) is 1 part by weight to 10 parts by weight, and more preferably 2 parts by weight to 7 parts by weight. When an inorganic filler is added in a configuration of organosol, the amount of addition adjusted to be controlled such that the solid content of the organosol be in the above-noted range.

The toner of the present invention, namely, a toner having a A/S value within the specified range and has a surface shape in which a toner surface has line-contact with individual members can be obtained by controlling the types of the inorganic filler and the amount of addition and manufacturing thereof.

2) The toner materials-contained solution is emulsified in an aqueous medium in the presence of a surfactant and resin fine particles. The aqueous medium may be water alone or may comprise an organic solvent made from, such as, alcohols (methanol, isopropyl alcohol, ethylene glycol, and the like); dimethylformamide; tetrahydrofuran; and Cellosolves (methyl cellosolve, and the like); and lower ketone (acetone, methyl ethyl ketone, and the like).

The amount of the aqueous medium is generally 50 parts by weight to 2,000 parts by weight, and preferably 100 parts by weight to 1,000 parts by weight relative to 100 parts by weight of the toner materials-contained solution. When the amount of aqueous medium is less than 50 parts by weight, the toner materials-contained solution may not be dispersed sufficiently, and the resulting toner particles may not have a predetermined average particle diameter. When it is more than 20,000 parts by weight, it is not unfavorable in terms of cost reduction.

Where necessary, a dispersing agent such as surfactants and resin fine particles can be used for better particle size distribution and more stable dispersion in the aqueous medium.

Examples of the surfactants include an anionic surfactants such as alkyl benzene sulphonates, α-olefin sulphonates, and phosphoric ester; amine salts cationic surfactants such as alkylamine salts, amino alcohol fatty acid derivatives, polyamine fatty acid derivatives, and imidazoline; quaternary ammonium salts cationic surfactants such as alkyltrimethylammonium salts, dialkyldimethylammonium salts, alkyldimethylbenzylammonium salts, pyridinium salts, alkylisoquinolium salts, and benzethonium chloride; nonionic surfactants such as fatty acid amide derivatives, and polyhydric alcohol derivatives; and amphoteric surfactants such as alanine, dedecyldi(aminoethyl)glycine, di(octylaminoethyl)glycine, N-alkyl-N,N-dimethylammonium betaine.

The effects of the surfactants can be obtained in a small amount by using a surfactant having a fluoroalkyl group. Preferred examples of anionic surfactants having a fluoroalkyl group are fluoroalkyl carboxylic acids each containing 2 to 10 carbon atoms, and metallic salts thereof, disodium perfluorooctanesulfonyl glutaminate, sodium 3-[ω-fluoroalkyl($C_6$ to $C_{11}$)oxy]-1-alkyl($C_3$ to $C_4$)sulfonate, sodium 3-[ω-fluoroalkanoyl($C_6$ to $C_8$)-N-ethylamino]-1-propanesulfonate, fluoroalkyl($C_{11}$ to $C_{20}$)carboxylic acids and metallic salts thereof, perfluoroalkyl carboxylic acids($C_7$ to $C_{13}$), and metallic salts thereof, perfluoroalkyl ($C_4$ to $C_{12}$) sulfonic acids and metallic salts thereof, perfluorooctanesulfonic acid diethanolamide, N-propyl-N-(2-hydroxyethyl) perfluorooctanesulfonamide, perfluoroalkyl($C_6$ to $C_{10}$)sulfonamide propyl trimethyl ammonium salts, perfluoroalkyl ($C_6$ to $C_{10}$)-N-ethylsulfonyl glycine salts, and monoperfluoroalkyl($C_6$ to $C_{16}$)ethyl phosphoric esters.

Such fluoroalkyl-containing anionic surfactants are commercially available under the trade names of, for example, Surflon S-111, S-112, and S-113 (manufactured by ASAHI GLASS CO., LTD.); Fluorad FC-93, FC-95, FC-98, and FC-129 (manufactured by Sumitomo 3M Ltd.); Unidyne DS-101, and DS-102 (manufactured by DAIKIN INDUSTRIES, LTD.); Megafac F-110, F-120, F-113, F-191, F-812, and F-833 (manufactured by Dainippon Ink & Chemicals, Inc.); EFTOP EF-102, 103, 104, 105, 112, 123A, 123B, 306A, 501, 201, and 204 (manufactured by JEMCO Inc.); and FTERGENT F-100 and F150 (manufactured by NEOS Co., Ltd).

Examples of fluoroalkyl-containing cationic surfactants for use in the present invention include aliphatic primary, secondary and tertiary amic acids each having a fluoroalkyl group; aliphatic quaternary ammonium salts such as perfluoroalkyl (C6 to C10) sulfonamide propyltrimethyl ammonium salts; benzalkonium salts, benzethonium chloride, pyridinium salts, and imidazolium salts. Such fluoroalkyl-containing cationic surfactants are commercially available, for example, under the trade names of Surflon S-121 (manufactured by ASAHI GLASS CO., LTD.); FLUORAD FC-135 (manufactured by Sumitomo 3M Ltd.); Unidyne DS-202 (manufactured by DAIKIN INDUSTRIES, LTD.); Megafac F-150, and F-824 (manufactured by Dainippon Ink & Chemicals, Inc.); EFTOP EF-132 (manufactured by JEMCO Inc.); and FTERGENT F-300 (manufactured by NEOS Co., Ltd).

The resin fine particles are used for stabilizing the toner base particles to be formed in the aqueous medium. To this end, it is preferable to add resin fine particles so that each toner base particle has a surface coverage of 10% to 90%. Examples of such resin fine particles include 1 μm and 3 μm of poly(methyl methacrylate) fine particles, 0.5 μm and 2 μm of polystyrene fine particles, and 1 μm of poly(styrene-acrylonitrile) fine particles. These resin fine particles are commercially available, for example, under the trade names of PB-200H (manufactured by KAO CORPORATION); SGP (manufactured by Soken Chemical & Engineering Co., Ltd.); Techno Polymer SB (manufactured by SEKISUI CHEMICAL CO., LTD.); SGP-3G (manufactured by Soken Chemical & Engineering Co., Ltd.); and Micro Pearl (manufactured by SEKISUI CHEMICAL CO., LTD.).

In addition, inorganic compounds such as tricalcium phosphate, calcium carbonate, titanium oxide, colloidal silica, and hydroxyl apatite can be also used as the dispersant.

For further stabilizing the primary particles in the dispersion, a polymeric protective colloid can be used as a dispersing agent in combination with any of the resin fine particles and inorganic compound dispersing agent. Examples of the polymeric protective colloid include homopolymers and copolymers of acids such as acrylic acid, methacrylic acid, α-cyanoacrylic acid, α-cyanomethacrylic acid, itaconic acid, crotonic acid, fumaric acid, maleic acid, and maleic anhydride; hydroxyl-group-containing (meth) acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerol monoacrylic ester, glycerol monomethacrylic ester, N-methylolacrylamide, and N-methylolmethacrylamide; vinyl alcohol and esters thereof such as vinyl methyl ether, vinyl ethyl ether, and vinyl propyl ether; esters of vinyl alcohol and a carboxyl-group-containing compound such as vinyl acetate, vinyl propionate, and vinyl butyrate; acrylamide, methacrylamide, diacetone acrylamide, and methylol compounds thereof; acid chlorides such as acryloyl chloride, and methacryloyl chloride; nitrogen-containing or heterocyclic compounds such as vinylpyridine, vinylpyrrolidone, vinylimidazole, and ethyleneimine; polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ether, polyoxyethylene lauryl phenyl ether, polyoxyethylene stearyl phenyl ester, and polyoxyethylene nonyl phenyl ester; and cellulose derivatives such as methyl cellulose, hydroxymethyl cellulose, and hydroxypropyl cellulose.

The dispersing procedure is not particularly limited and includes known procedures such as low-speed shearing, high-speed shearing, dispersing by friction, high-pressure jetting, ultrasonic dispersion. To allow the dispersed particles to have an average particle diameter of 2 μm to 20 μm, the high-speed shearing procedure is preferred. When a high-speed shearing dispersing machine is used, the number of rotation is not particularly limited and is generally from 1,000 rpm to 30,000 rpm, and preferably from 5,000 rpm to 20,000 rpm. The amount of dispersion time is not particularly limited and is generally from 0.1 minutes to 5 minutes in a batch system. The dispersing temperature is generally from 0° C. to 150° C. under a pressure (under a load), and preferably from 40° C. to 98° C.

3) In parallel with preparation of the emulsified liquid, amines (B) are added to the emulsified liquid to be reacted to a polyester prepolymer having an isocyanate group (A). The reaction is involved in cross-linking and/or elongation of molecular chains. The reaction time for cross-linking and/or elongation is appropriately set depending on the reactivity derived from the combination of the isocyanate structure of the polyester prepolymer (A) and the amines (B) and is generally from 10 minutes to 40 hours, and preferably 2 hours to 24 hours. The reaction temperature is generally 0° C. to 150° C., and preferably 40° C. to 98° C. Where necessary, a catalyst known in the art may be used as required. Specifically, examples of the catalyst include a dibutyltin laurate, and a diocryltin laurate.

4) After completion of the reaction, the organic solvent is removed from the emulsified dispersion (reaction mixture) and the residue is washed and dried to obtain toner base particles.

The entire system is gradually raised in temperature while stirring as a laminar flow, is vigorously stirred at set temperature, and the organic solvent is removed to thereby yield toner base particles. When calcium phosphate salts or another dispersion stabilizer that is soluble in acid or base is used, the dispersion stabilizer is removed from the fine particles by dissolving the dispersion stabilizer by action of an acid such as hydrochloric acid and washing the fine particles. Alternatively, the component can be removed, for example, by enzymatic decomposition.

5) A charge-controlling agent is implanted into the obtained toner base particles, and then inorganic fine particles such as silica fine particles, and titanium oxide fine particles are added to the toner base particles as external additives and thereby yield a toner for electrophotography.

The implantation of a charge-controlling agent and the external addition of inorganic particles are performed according to a conventional procedure using a mixer, for example, a mixer.

Thus, a toner having a small particle diameter with sharp particle size distribution can be easily obtained (without any considerable variation of particle size distribution). In addition, the surface of the toner base particles can be morphologically controlled within ranges from smooth surface to shriveled surface.

The toner of the present invention can be used as a tow-component developer by mixing it with carrier particles containing magnetic particles. In this case, the rate of content of the carrier particles to the toner in the developer is preferably 100 parts by weight of carrier to 1 part by weight to 10 parts by weight of toner. For the magnetic carrier particles, magnetic carrier particles having a particle diameter of 20 μm to 200 μm, known in the art, such as, an iron powder, a ferrite powder, a magnetite powder, and a magnetic resin carrier, may be used. Examples of covering materials of the toner include an amino resin, such as, a urea-formaldehyde resin, a melamine resin, a benzoguanamine resin, a urea resin, a polyamide resin, and an epoxy resin. As the covering materials, it is also possible to use a polyvinyl resin and a polyvinylidene resin, such as, an acrylic resin, a polymethyl methacrylate resin, a polyacrylonitrile resin, a polyvinyl acetate resin, a polyvinyl alcohol resin, and a polyvinyl butyral resin; a polystyrene resin, such as, a polystyrene resin, and a styrene-acryl copolymer resin; a halogenated olefin resin, such as, a polyvinyl chloride; a polyester resin, such as, a polyethylene terephthalate resin, and a polybutylene terephthalate resin; a polycarbonate resin, a polyethylene resin, a polyvinyl fluoride resin, a polyvinylidene fluoride resin, a polytrifluoro ethylene resin, a polyhexafluoro propylene resin, a copolymer of vinylidene fluoride and acryl monomer, a copolymer of vinylidene fluoride and vinyl fluoride; a fluorotarpolymer, such as, a tarpolymer of tetrafluoro ethylene and vinylidene fluoride and non-fluoride monomer; and a silicon resin, and the like. In addition, a conductive powder may be included in the covering resin material where necessary. As for the conductive powder, metal powder, carbon black, a titanium oxide, a tin oxide, a zinc oxide or the like can be used. The average particle diameter of these conductive powders is preferably 1 μm or less. When the average particle diameter is more than 1 μm, it becomes difficult to control electric resistivity.

In addition, the toner of the present invention can be used as a one-component magnetic toner or a non-magnetic toner in which no carrier is used.

On the occasion of preparing the developer, to improve fluidity of the developer, keeping quality, developing properties, and transferring properties, the above-noted inorganic particles, such as, a hydrophobic silica fine particle powder, may be further added to and mixed with the developer manufactured as stated above. A generally used mixer for powder is used in mixing external additives, however, a mixer equipped with a jacket or the like and capable of controlling the inside temperature thereof is preferable. To change history of load to be applied to the external additives, the external additives may be added in the course of mixing or by degrees. Of course, rotation speed of a mixer, rolling speed, mixing time, temperature, or the like may be altered. A heavy load may be given first, and then a relatively light load may be given to the mixer or may be conversely.

Examples of a usable mixer include a V-shaped mixer, a rocking mixer, a Ledige mixer, a Nauter mixer, and a Henschel mixer.

Figure 4:
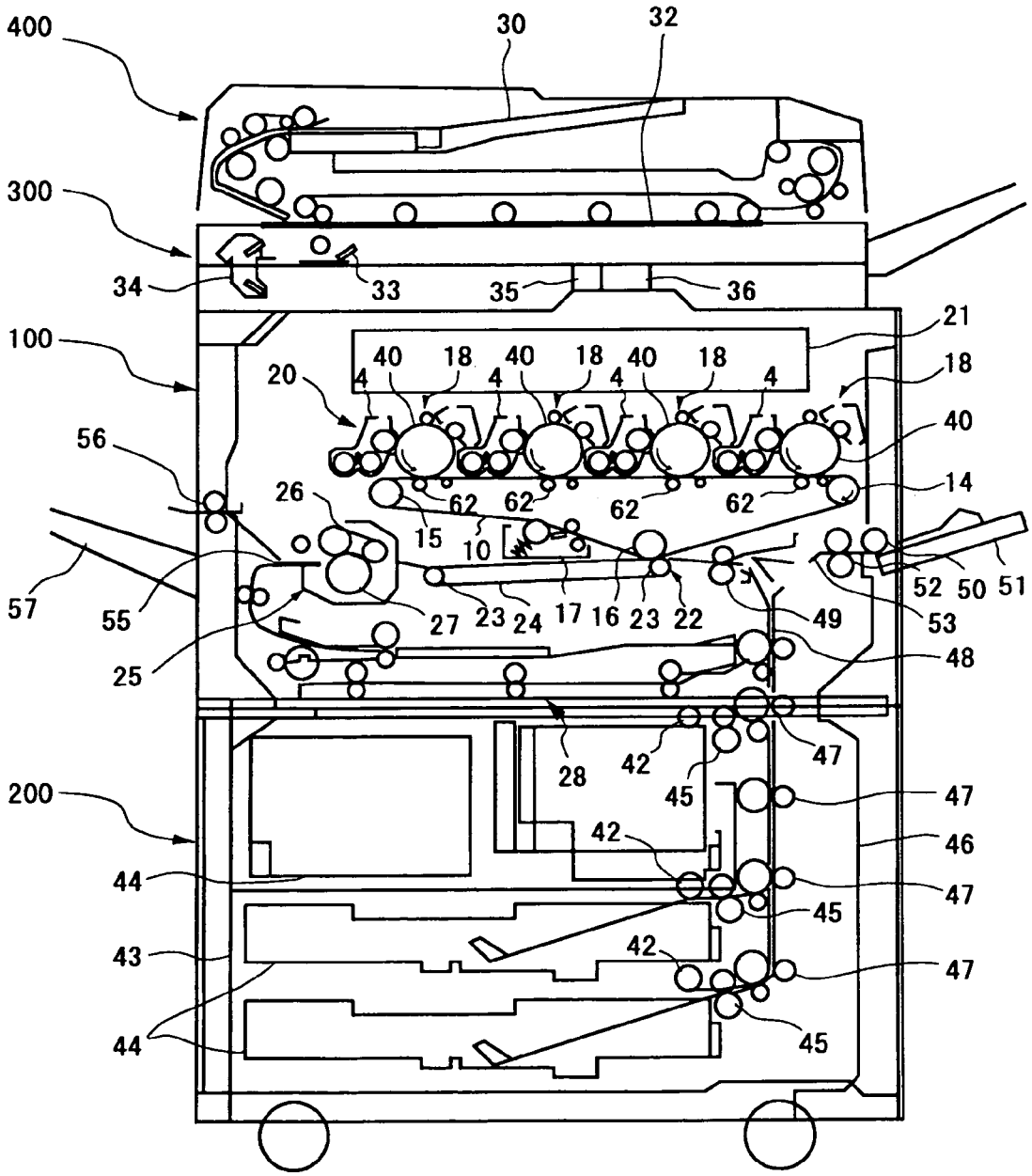
FIG. 4 is a schematic block diagram showing an example of an image forming apparatus relating to the present invention.

Hereafter, the image forming apparatus in which the toner of the present invention is used as a developer will be described. FIG. 4 is a block diagram schematically showing an example of the image forming apparatus relating to the present invention. In FIG. 4, the image forming apparatus comprises a copier main body 100, a sheet-feeder table 200 configured to carry the main body thereon, a scanner 300 configured to be mounted on the copier main body 100, an automatic document feeder (ADF) 400 configured to be further mounted on the scanner 300.

The copier main body 100 comprises a tandem image forming apparatus 20 having image forming units 18 in which individual units for performing electrophotographic processes, such as, a charging unit, a developing unit, and a cleaning unit, are included and arranged in four parallel lines around a photoconductor 40 as a latent electrostatic image carrier. On the upper side of the tandem image forming apparatus, an exposer configured to expose the photoconductor 40 based on image information by a laser beam to form a latent image is mounted. An intermediate transfer belt 10 made from an endless belt member is arranged such that the transferring belt 10 faces each photoconductor 40 in the tandem image forming apparatus 20. At the positions opposed to each photoconductor 40 through the intermediate transfer belt 10, a primary transferring units 62 configured to transfer a toner image formed in each color on the photoconductor onto the intermediate transfer belt 10 is located.

A secondary transfer apparatus 22 configured to transfer the toner image superimposed on the intermediate transfer belt 10 to a transferring paper transported from the sheet-feeder table 200 in block is located beneath the intermediate transfer belt 10. The secondary transfer apparatus 22 is configured to have a secondary transferring belt 24 being an endless belt which is spanned over two rollers 23 and is located to be pressed against a supporting roller 16 through the intermediate transfer belt 10 to transfer the toner image on the intermediate transfer belt 10 onto a transferring paper.

An image fixing apparatus 25 configured to fix the image on the transferring paper is located beside the secondary transfer apparatus 22. The image fixing apparatus 25 is configured such that a pressure roller 27 is pressed against the fixing belt 26 being an endless belt.

The above-noted secondary transfer apparatus 22 also comprises a sheet-transportation function in which a transferring paper with an image transferred thereon is transported to the image fixing apparatus 25. Of course, a transferring roller and a noncontact charger may be located in the secondary transfer apparatus 22. In such a case, it becomes difficult to provide with the sheet-transportation function.

In the example as shown in the figure, a sheet reversing apparatus 28 that flips a sheet upside down in order to record images on both sides of the sheet is located below the secondary transfer apparatus 22 and the image fixing apparatus 25 and parallel to the tandem image forming device 20.

A developer with the above-noted toner included therein is used for an image developing apparatus 4 in the image forming unit 18. In the image developing apparatus 4, a developer carrier carries and transports a developer to the position where the image developing apparatus 4 faces the photoconductor 40 and applies an alternating electric field to the photoconductor 40 then to develop a latent image on the photoconductor 40. Applying an alternating electric field makes it possible to activate a developer and to narrow down distribution of toner charge volume and to improve developing properties.

The image developing apparatus 4 may be a process cartridge configured to be supported with the photoconductor 40 in a single body and mounted to the main body of the image forming apparatus in an attachable and detachable fashion. In addition, the process cartridge may comprise a charging unit and a cleaning unit.

Actions of the image forming apparatus are as follows.

First, an original document is set on a document table 30 of the automatic document feeder 400. Or, alternatively, the automatic document feeder 400 may be opened to set the document on a contact glass 32 of the scanner 300 and closed thereafter to hold down the document inside thereof.

Then, by pressing a start switch (not shown), the scanner 300 is activated and a first moving body 33 and a second moving body 34 start to move after the document is carried onto the contact glass 32 if it is set in the automatic document feeder 400, or, immediately after the start switch is pressed if the document is place on the contact glass 32. Thereafter, a laser beam is irradiated from a light source in the first moving body 33, and a reflected laser beam from the document is once again reflected to the first moving body 33 toward the second moving body 34. Mirrors in the second moving body 34 reflect the laser beam toward a reading sensor 36 through an imaging lens 35 and thus the content of the document is read.

By pressing the start switch (not shown), a drive motor (not shown) rotationally drives one of the supporting rollers 14, 15, and 16, and indirectly rotates two other supporting roller so that the intermediate transfer belt 10 is rotationally moved. At the same time, at each image forming units 18, its photoconductor 40 rotates, and monochrome images of black, yellow, magenta, and cyan are formed on each photoconductor 40. Then, as the intermediate transfer belt 10 moves, these monochrome images are successively transferred to form a composite color image on the intermediate transfer belt 10.

Also, by pressing the start switch (not shown), one of sheet feeder rollers 42 of the sheet feeder table 200 is selected and driven so as to advance a sheet from one of sheet feeder cassettes 44 that is stacked vertically in a paper bank 43. The sheet is separated from another by a separating roller 45 and advanced to a sheet feeder path 46. Then, carrying roller 47 carries the sheet to guide the sheet to a sheet feeder path 48 in the main body 100 where the sheet hits a resist roller 49 and is stopped.

Alternatively, sheet feeder roller 50 is rotated to advance a sheet from a manual bypass tray 51. Then, a separating roller 52 separates the sheet from other sheets and introduces the sheet to a manual bypass sheet feeder path 53 where the sheet hits a resist roller 49 and is stopped.

Then, the resist roller 49 rotates in time with the composite color image on the intermediate transfer belt 10 and advances the sheet between the intermediate transfer belt 10 and the secondary transfer apparatus 22 where the secondary transfer apparatus 22 transfers the composite color image onto the sheet to record the color image.

After the image transfer, the secondary transfer apparatus 22 carries the sheet to the image fixing apparatus 25 where the image fixing apparatus 25 applies heat and pressure to fix the transferred image. Thereafter, a switching flap 55 switches so that the sheet is ejected by an ejecting roller 56 and stacked on a paper output tray 57.

After image transfer, the intermediate transfer belt cleaning apparatus 17 removes residual toner remaining on the intermediate transfer belt 10 so that the intermediate transfer belt 10 is ready for the next image forming by the tandem image forming apparatus 20.

EXAMPLES

The present invention will be described in detail referring to specific examples hereafter.

Example 1

Synthesis of Organic Fine Particle Emulsion

To a reaction vessel provided with a stirrer and a thermometer, 683 parts of water, 11 parts of sodium salt of the sulfuric acid ester of methacrylic acid ethylene oxide adduct (ELEMINOL RS-30, manufactured by Sanyo Chemical Industries, Ltd.), 80 parts of styrene, 83 parts of methacrylic acid, 110 parts of butyl acrylate, 12 parts of butyl thioglycollate, and 1 part of ammonium persulphate were introduced, and stirred at 400 rpm/minute for 15 minutes to obtain a white emulsion. The white emulsion was heated, the temperature in the system was raised to 75° C. and the reaction was performed for 5 hours. Next, 30 parts of an aqueous solution of 1% ammonium persulphate was added, and the reaction mixture was matured at 75° C. for 5 hours to obtain an aqueous dispersion liquid of a vinyl resin (copolymer of styrene-methacrylic acid-butyl acrylate-sodium salt of the sulfuric acid ester of methacrylic acid ethylene oxide adduct). This aqueous solution was taken as "particulate emulsion 1". The volume mean particle diameter of the "particulate emulsion 1" measured by a laser diffraction particle size distribution analyzer (LA-920, manufactured by SHIMADZU Corp.) was 120 nm. After drying part of "particulate emulsion 1" and isolating the resin, the glass transition temperature (Tg) of the resin was 42° C. and the weight average molecular weight was 30,000.

Preparation of Aqueous Phase

To 990 parts of water, 83 parts of "particulate emulsion 1", 37 parts of a 48.5% aqueous solution of sodium dodecyl diphenylether disulfonic acid (ELEMINOL MON-7, manufactured by Sanyo Chemical Industries, Ltd.) and 90 parts of ethyl acetate were mixed and stirred together to obtain a milky liquid. This was taken as "aqueous phase 1".

Synthesis of Low Molecular Weight Polyester

In a reaction vessel equipped with a condenser tube, a stirrer, and a nitrogen inlet tube, 229 parts of bisphenol A ethylene oxide dimolar adduct, 529 parts of bisphenol A propylene oxide trimolar adduct, 208 parts of terephthalic acid, 46 parts of adipic acid and 2 parts of dibutyl tin oxide were placed, and the reaction was performed under normal pressure at 230° C. for 8 hours, and the reaction was further performed under a reduced pressure of 10 mmHg to 15 mmHg for 5 hours, then 44 parts of anhydrous trimellitic acid was introduced into the reaction vessel, and the reaction was performed at 180° C. under normal pressure for 2 hours to obtain a polyester. This polyester was taken as "low molecular weight polyester 1." "Low molecular weight polyester 1" had a number mean molecular weight of 2,500, a weight mean molecular weight of 6,700, a glass transition temperature (Tg) of 43° C. and an acid value of 25.

Synthesis of Intermediate Polyester

In a reaction vessel equipped with a condenser tube, a stirrer, and a nitrogen inlet tube, 682 parts of bisphenol A ethylene oxide dimolar adduct, 81 parts of bisphenol A propylene oxide dimolar adduct, 283 parts of terephthalic acid, 22 parts of anhydrous trimellitic acid and 2 parts of dibutyl tin oxide were placed, and the reaction was performed under normal pressure at 230° C. for 8 hours, and then the reaction was further performed under a reduced pressure of 10 mmHg to 15 mmHg for 5 hours to obtain a polyester. This polyester was taken as "intermediate polyester 1." "Intermediate polyester 1" had a number average molecular weight of 2,100, a weight average molecular weight of 9,500, a glass transition temperature (Tg) of 55° C., an acid value of 0.5 and a hydroxyl value of 51.

Next, 410 parts of "intermediate polyester 1", 89 parts of isohorone diisocyanate and 500 parts of ethyl acetate were placed in a reaction vessel equipped with a condenser tube, a stirrer, and a nitrogen inlet tube, and the reaction was performed at 100° C. for 5 hours to obtain a reactant. This reactant was taken as "prepolymer 1." The free isocyanate % by weight of"prepolymer 1" was 1.53%.

Synthesis of Ketimine

Into a reaction vessel equipped with a stirrer and a thermometer, 170 parts of isohorone diamine and 150 parts of methyl ethyl ketone were introduced, and the reaction was performed at 50° C. for 5 hours to obtain "ketimine compound 1." The amine value of "ketimine compound 1" was 418.

Synthesis of Masterbatch

To 1200 parts of water, 540 parts of carbon black (Printex 35, manufactured by Degussa AG) [DBP oil absorption amount=42 ml/100 mg, pH=9.5] and 1200 parts of polyester resin (RS801, manufactured by Sanyo Chemical Industries, Ltd.) were added and mixed in a Henschel mixer (manufactured by MITSUI MINING CO., LTD.) then the mixture was kneaded at 150° C. for 30 minutes using two rollers, extrusion cooled and crushed with a pulverizer to obtain "masterbatch 1."

Preparation of Oil Phase

Into a vessel equipped with a stirrer and thermometer, 378 parts of "low molecular weight polyester 1," 110 parts of carnauba wax, and 947 parts of ethyl acetate were introduced, and the temperature was raised to 80° C. with stirring, maintained at 80° C. for 5 hours, and cooled to 30° C. in 1 hour. Next, 500 parts of "masterbatch 1" and 500 parts of ethyl acetate were introduced into the vessel, and mixed for 1 hour to obtain "initial material solution 1."

To a vessel, 1324 parts of "initial material solution 1" were transferred, and carbon black and wax were dispersed using a bead mill (Ultra Visco Mill, manufactured by AIMEX CO., LTD.) under the conditions of liquid feed rate 1 kg/hr, disk circumferential speed of 6 m/sec, 0.5 mm zirconia beads packed to 80% by volume and 3 passes. Next, 1324 parts of 65% ethyl acetate solution of "low molecular weight polyester 1" was added and dispersed in 1 pass by the bead mill under the above-noted conditions to obtain a dispersion liquid. This was taken as "pigment/WAX dispersion liquid 1." The solids concentration of "pigment/WAX dispersion liquid 1" (130° C.) was 50%.

Emulsification and Solvent Removal)

In a vessel, 749 parts of "pigment/WAX dispersion liquid 1", 115 parts of "prepolymer 1", 2.9 parts of "ketimine compound 1" and 76 parts of MEK-ST-UP (solid content 20%; manufactured by NISSAN CHEMICAL INDUSTRIES, LTD.) were placed and mixed at 5,000 rpm for 1 minute by a TK homomixer (manufactured by TOKUSHU KIKA KOGYO CO., LTD.), then 1200 parts of "aqueous phase 1" were added to the vessel and mixed in the TK homomixer at a rotation speed of 13,000 rpm for 20 minutes to obtain an emulsion. This was taken as "emulsion slurry 1."

"Emulsion slurry 1" was placed in a vessel equipped with a stirrer and a thermometer, then the solvent was removed at 30° C. for 8 hours and the product was matured at 45° C. for 4 hours to obtain "dispersion slurry 1." "Dispersion slurry 1" had a volume mean diameter of 5.99 μm and a number mean diameter of 5.70 μm (measured by a Multisizer II).

Rinsing, Drying, and Fluorination

After filtering 100 parts of "dispersion slurry 1" under reduced pressure, (1): 100 parts of ion exchange water were added to the filter cake, mixed in a TK homomixer (rotation speed 12,000 rpm, 10 minutes) and filtered.

(2): 100 parts of 10% hydrochloric acid were added to the filter cake of (1), mixed in a TK homomixer (rotation speed 12,000 rpm, 10 minutes) and filtered.

(3): 300 parts of iron exchange water were added to the filter cake of (2), mixed in a TK homomixer (rotation speed 12,000 rpm, 10 minutes), and filtered twice to obtain "filter cake 1."

"Filter cake 1" was dried in a circulating air dryer at 45° C. for 48 hours, thereafter 15 parts of "filter cake 1" was added to 90 parts of water and dried in the circulating air dryer at 45° C. for 48 hours, and then sieved through a sieve of 75 μm mesh to obtain "toner base particles 1."

External Addition

To 100 parts of the obtained "toner base particles 1", 0.7 parts of hydrophobic silica and 0.3 parts of hydrophobized titanium oxide were mixed in a Henschel mixer to obtain a toner.

Example 2

A toner was obtained in the same manner as Example 1 except that the process for emulsification and solvent removal was changed to the conditions as described below.

Emulsification and Solvent Removal

In a vessel, 749 parts of "pigment/WAX dispersion liquid 1," 115 parts of "prepolymer 1" and 2.9 parts of "ketimine compound 1" were placed and mixed at 5,000 rpm for 2 minutes by a TK homomixer (manufactured by TOKUSHU KIKA KOGYO CO. LTD.), then 1,200 parts of "aqueous phase 1" were added to the vessel and mixed in the TK homomixer at a rotation speed of 13,000 rpm for 10 minutes to obtain "emulsion slurry 2."

"Emulsion slurry 2" was placed in a vessel equipped with a stirrer and a thermometer, then the solvent was removed at 30° C. for 6 hours and the product was matured at 45° C. for 5 hours to obtain "dispersion slurry 2."

Example 3

A toner is obtained in the same manner as Example 1 except that the process for emulsification and solvent removal was changed to the conditions as described below.

Emulsification and Solvent Removal

In a vessel, 749 parts of "pigment/WAX dispersion liquid 1," 115 parts of "prepolymer 1" and 2.9 parts of "ketimine compound 1" were placed and mixed at 5,000 rpm for 2 minutes by a TK homomixer (manufactured by TOKUSHU KIKA KOGYO CO. LTD.), then 1,200 parts of "aqueous phase 1" were added to the vessel and mixed in the TK homomixer at rotation speed of 13,000 rpm for 40 minutes to obtain "emulsion slurry 3."

"Emulsion slurry 3" was placed in a vessel equipped with a stirrer and thermometer, then the solvent was removed at 30° C. for 8 hours and the product was matured at 45° C. for 5 hours to obtain "dispersion slurry 3."

Comparative Example 1

A toner was obtained in the same manner as Example 1 except that MEK-ST-UP (solid content 20%; manufactured by NISSAN CHEMICAL INDUSTRIES, LTD.) was not added in the process for preparation of oil phase.

Comparative Example 2

Toner initial materials made from 100 parts of styrene-n-butyl-acrylate copolymer resin, 10 parts of carbon black, and 4 parts of polypropylene were preliminarily mixed by a Henschel mixer, fused and kneaded by a tandem extruder and crushed by a hammer mill and then reduced into a powder by a jet mill to obtain a powder. The obtained powder was dispersed in thermal current of a spray dryer to obtain particles being tuned in shape. The particles were repeatedly classified by a wind force classifier until an intended particle size distribution was obtained. To 100 parts of the obtained and colored particles, 1 part of silica particles was added and mixed in a Henschel mixer to obtain a toner.

Images were formed using the toners obtained in Examples 1 to 3 and Comparative Examples 1 and 2 to evaluate the results as to the items described below.

(Evaluation Items)

1) Transferring Rate

After transferring a 20% image-area ratio chart to a sheet of paper from a photoconductor, transfer residual toner remaining on the photoconductor immediately before a cleaning step was transferred to a sheet of white paper using a scotch tape (manufactured by Sumitomo 3M Limited) to measure the reflection density by a reflection densitometer (Macbeth reflection densitometer RD514). A toner which had a difference in reflection density from that of the blank portion of the paper being less than 0.005 was evaluated as "excellent", a toner which had a difference thereof being 0.005 to 0.010 was evaluated as "good", a toner which had a difference thereof being 0.011 to 0.02 was evaluated as "passable," and a toner which had a difference thereof being 0.02 or more was evaluated as "poor."

2) Transferring Dust

After checking dust at the time of developing, a toner image on the photoconductor was transferred onto a sheet of paper under the same conditions, and presence or absence of toner on a white line in thin lines of a not-fixed image before fixing step was judged by visual check. A toner which had no problem with its practical use was evaluated as "good," a toner which had no problem with its practical use but the quality being somewhat inferior was evaluated as "passable," and a toner which had some problems with its practical use was evaluated as "poor."

2) Cleaningability

After outputting 1,000 sheets of a 95% image-area ratio chart, transfer residual toner remaining on the photoconductor which had gone through a cleaning step was transferred to a sheet of white paper using a scotch tape (manufactured by Sumitomo 3M Limited) to measure the reflection density by a reflection densitometer (Macbeth reflection densitometer RD514). A toner which had a difference in reflection density from that of the blank portion of the paper being less than 0.005 was evaluated as "excellent", a toner which had a difference thereof being 0.005 to 0.010 was evaluated as "good", a toner which had a difference thereof being 0.011 to 0.02 was evaluated as "passable," and a toner which had a difference thereof being 0.02 or more was evaluated as "poor."

3) Fixability

An Imagio NEO 450 copier (manufactured by Ricoh Co., Ltd.) was modified and tuned to a system taking a belt fixing approach. Using the modified copier, solid images with adhering toner amount of 1.0 mg/cm$^2$±0.1 mg/cm$^2$ were printed on transferring sheets of plain paper and heavy paper (duplicator printing paper 6200 and NBS, respectively manufactured by Ricoh co., Ltd.) and evaluated as to its fixability. The fixing test was performed while changing the temperature of the fixing belt, and an upper limit fixing temperature at which no hot offset occurred on plain paper was taken as the upper limit temperature of fixing. The lower limit fixing temperature was also measured using heavy paper. A fixing roll temperature at which the residual ratio of image density after an obtained fixing image rubbed with a pad being 70% or more was taken as the lower limit fixing temperature. A toner that satisfied the upper limit fixing temperature of 190° C. or more and the lower limit fixing temperature of 140° C. or less was evaluated as "good." A toner that did not satisfy the above-noted condition was evaluated as "poor."

Tables 1 and 2 show the characteristic values (properties) and evaluation results of the above-mentioned individual toners. With respect to a value of ratio (D/S) of the total contact area between a toner and a latent image carrier, or an intermediate transferring member, or a fixing member (A, or B, or C) to the total projection area of the toner (S), as an alternative value thereof, a value measured as the total contact area between a toner and a glass plane plate when the toner is dropped and placed on the horizontally kept glass plane plate from above a height of 10 cm of the glass plane plate while sieving the toner through a sieve of 22 μm mesh for 10 seconds is defined as the ratio (D/S). It is noted that a value of D was calculated as follows. A photograph of the glass plane plate was taken from the opposite direction side of the toner through the glass plane plate using a high-resolution digital camera, only contact parts of a toner image were blacked out using an image processor (LuzexAP, NIRECO Corporation), and the contacts parts were added up and defined as a contact area (D). A value of A, or B, or C was calculated as follows. Transparent pseudo resin members were prepared for places corresponding to a latent image carrier, an intermediate transferring member, or a fixing member, a CCD camera was located inside of the pseudo latent image carrier, intermediate transferring member, or fixing member respectively, thereby taken images were measured and obtained in the same manner as stated above (measurement of a D value).

Each value of L/M (long axis/minor axis) shown in Table 1 is the average value of 10 toner particles after selecting and measuring the largest toner contact areas from given toner particles, when there were a plurality of contact areas between the toner and the glass plane plate. The values of long axis and minor axis were measured and obtained by means of image processing by blacking out only contact areas between a toner and a glass plane plate in an image taken by the digital camera using an image processor (LuzexAP, NIRECO Corporation).

TABLE 1

| | Properties of Toner | | | | | | |
|---|---|---|---|---|---|---|---|
| | Average circularity | D/S (%) | L/M | SF-2 (Shape Factor) | Dv (μm) | Dv/Dn | Content (%) of particle diameter corresponding to a circle being 2.0 μm or less based on number |
| Ex. 1 | 0.97 | 17.5 | 4 | 120 | 5.8 | 1.28 | 5.9 |
| Ex. 2 | 0.95 | 21.6 | 18 | 138 | 5.1 | 1.17 | 12.6 |
| Ex. 3 | 0.97 | 20.2 | 8 | 124 | 4.3 | 1.16 | 17.6 |
| Compara. Ex. 1 | 0.98 | 7.1 | 3 | 118 | 5.2 | 1.23 | 7.8 |
| Compara. Ex. 2 | 0.90 | 47.10 | 37 | 115 | 8.6 | 1.21 | 6.0 |

TABLE 2

| | Evaluation Results | | | |
|---|---|---|---|---|
| | Transferring Rate | Transferring Dust (Abnormal Image) | Cleaningability | Fixability |
| Ex. 1 | Good | Good | Good | Good |
| Ex. 2 | Good | Good | Good | Good |
| Ex. 3 | Good | Good | Good | Good |
| Compara. Ex. 1 | Excellent | Poor | Poor | Good |
| Compara. Ex. 2 | Poor | Good | Excellent | Poor |

The results shown in Tables 1 and 2 show that toners of Examples 1 to 3 which had an average circularity of 0.95 or more and a value of A/S ratio of the total contact area between the toner between a latent image carrier (A) to the total projection area of the toner (S) being from 15% to 40% respectively exemplified excellent results of a high transferring rate, no occurrence of transferring dust, and excellent cleaningability because the toners individually contacted with a latent image carrier, an intermediate transferring member, and a fixing member with a proper contact area. As to fixability of the toners, no image defect occurred. The toners also showed excellent results in hot offset resistivity and low-temperature image fixing properties. In addition, the toners of Examples 1 to 3 satisfied a relation of ratio (L/M) of the long axis L and the minor axis M being L/M>3 in the contact surface portion where the toner contacted with a glass plane plate.

On the other hand, the toner of Comparative Example 1 having a high average circularity and showing a low A/S value of 7.1% and an almost sphere shape showed a considerably high transferring rate, but brought about transferring dust, which caused defective images. In addition, the toner showed poor cleaningability. The toner of Comparative Example 2 having a low average circularity and showing a high A/S value of 47.1% and an indefinite (undetermined) shape did not show transferring dust but showed a low transferring rate and poor image quality level. The toner of Comparative Example 3 showed excellent cleaningability but showed poor fixability, particularly low-temperature image fixing properties was poor. The toners of Comparative Examples 1 and 2 respectively had a relation of ratio (L/M) of the long axis L and the minor axis M being L/M≧3 in the contact surface portion where the toner contacted with a glass plane plate.

As described in the above sections, it is possible to provide a toner which can achieve a balance between transferring properties, fixability, and cleaningability and can also form a high-precision image by controlling the toner surface shape so that the adherence between the toner and each member stays in a proper range.

It is also possible to provide a high quality and high-precision image through an image developing apparatus and an image forming apparatus in which the toner of the present invention is used.

What is claimed is:

1. A toner for developing an electrostatic image comprising:

a binder resin, and a colorant, wherein the toner has an average circularity of 0.95 or more and a ratio of the total contact area of the toner "D" to the total projection area of the toner "S" being 15% to 40%, and the total contact area of the toner "D" is the total area of contact surface portions between the toner and an object surface.

2. The toner for developing an electrostatic image according to claim 1, wherein the total contact area of the toner "D" is defined as the total area of contact surface portions between the toner and a glass plane plate when the toner being dropped and placed on the horizontally kept glass plane plate from above a height of 10 cm of the glass plane plate while sieving the toner through a sieve of 22 μm mesh for 10 seconds.

3. The toner for developing an electrostatic image according to claim 2, wherein the toner has a ratio "L/M," a long axis to a minor axis of a contact surface portion between the toner and the glass plane plate, satisfying a relation of "L/M>3" in at least one contact surface portion.

4. The toner for developing an electrostatic image according to claim 1, wherein the total contact area of the toner "D" is the total area of the contact surface portions between the toner and a latent image carrier "A", and the toner has a ratio "D/S", the total contact area of the toner "D" to the total projection area of the toner "S", being a ratio "A/S", the total area of the contact surface portions between the toner and the latent image carrier "A" to the total projection area of the toner "S".

5. The toner for developing an electrostatic image according to claim 4, wherein the toner has a ratio "L/M", a long axis to a minor axis of a contact surface portion between the toner and a latent image carrier, satisfying a relation of "L/M>3" in at least one contact surface portion.

6. The toner for developing an electrostatic image according to claim 1, wherein the total contact area of the toner "D" is the total area of the contact surface portions between the toner and an intermediate transferring member "B", and the toner has a ratio "D/S", the total contact area of the toner "D" to the total projection area of the toner "S", being a ratio "B/S", the total area of the contact surface portions between the toner and the intermediate transferring member "B" to the total projection area of the toner "S".

7. The toner for developing an electrostatic image according to claim 6, wherein the toner has a ratio "L/M," a long axis to a minor axis of a contact surface portion between the toner and the intermediate transferring member, satisfying a relation of "L/M>3" in at least one contact surface portion.

8. The toner for developing an electrostatic image according to claim 1, wherein the total contact area of the toner "D" is the total area of the contact surface portions between the toner and a fixing member "C", and the toner has a ratio "D/S", the total contact area of the toner "D" to the total projection area of the toner "S", being a ratio "C/S", the total area of the contact surface portions between the toner and the fixing member "C" to the total projection area of the toner "S".

9. The toner for developing an electrostatic image according to claim 8, wherein the toner has a ratio "L/M," a long axis to a minor axis of a contact surface portion between the toner and the fixing member, satisfying a relation of "L/M>3" in at least one contact surface portion.

10. The toner for developing an electrostatic image according to claim 1, wherein the toner has a shape factor value of SF-2 of 120 to 150.

11. The toner for developing an electrostatic image according to claim 1, wherein the toner has a volume mean diameter "Dv" of 3.0 μm to 8.0 μm and a ratio "Dv/Dn" of the volume mean diameter "Dv" to a number mean diameter "Dn" of 1.00 to 1.30.

12. The toner for developing an electrostatic image according to claim 1, wherein the toner has a 20% or less toner particle content of a particle diameter corresponding to a circle being 2.0 μm or less on a number basis.

13. The toner for developing an electrostatic image according to claim 1, wherein the binder resin comprises a modified polyester.

14. The toner for developing an electrostatic image according to claim 13, wherein the binder resin further comprises an unmodified polyester and has a weight-to-weight ratio of the modified polyester to the unmodified polyester of 5:95 to 80:20.

15. The toner for developing an electrostatic image according to claim 13, wherein the toner is obtained by carrying out a cross-linking reaction and/or an elongation reaction of a dispersion liquid of toner materials in which a polyester prepolymer having at least a nitrogen functional group, a polyester, a colorant, a releasant, and an inorganic filler are dispersed in an organic solvent, in an aqueous medium.

16. A two-component developer comprising:

a toner for developing an electrostatic image, and carrier particles which comprises magnetic particles, wherein the toner for developing an electrostatic image is a toner which comprises a binder resin and a colorant, and wherein the toner has an average circularity of 0.95 or more and a ratio "D/S", the total contact area of the toner "D" to the total projection area of the toner "S" being 15% to 40%, and the total contact area of the toner "D" is the total area of contact surface portions between the toner and an object surface.

17. A one-component developer comprising:

a toner for developing an electrostatic image, wherein the toner for developing an electrostatic image is a toner which comprises a binder resin and a colorant, and wherein the toner has an average circularity of 0.95 or more and a ratio "D/S", of the total contact area of the toner "D" to the total projection area of the toner "S" being 15% to 40%, and the total contact area of the toner "D" is the total area of contact surface portions between the toner and an object surface.

18. An image developing apparatus comprising:

a developer, a developer carrier, and a latent image carrier, wherein the developer is carried and transported by the developer carrier to a position opposed to the latent image carrier to form an electric field and develop a latent electrostatic image on the latent image carrier, wherein the developer comprises a toner which comprises a binder resin and a colorant, and wherein the toner has an average circularity of 0.95 or more and a ratio "D/S", of the total contact area of the toner "D" to the total projection area of the toner "S" being 15% to 40%, and the total contact area of the toner "D" is the total area of contact surface portions between the toner and an object surface.

19. A process cartridge comprising:

a latent image carrier, and a developing unit, wherein the developing unit comprises a developer and is configured to supply the developer to a latent electrostatic image formed on a surface of the latent image carrier to develop the image into a visible image, wherein the latent image carrier and the developing unit are formed in a single body and mounted to the main body of an image forming apparatus in an attachable and detachable fashion, wherein the developing unit is an image developing apparatus in which a developer is carried and transported by a developer carrier to form a magnetic field in a position opposed to the latent image carrier and to develop a latent electrostatic image on the latent image carrier, wherein the developer comprises a toner which comprises a binder resin and a colorant, and wherein the toner has an average circularity of 0.95 or more and a ratio "D/S", of the total contact area of the toner "D" to the total projection area of the toner "S" being 15% to 40%, and the total contact area of the toner "D" is the total area of contact surface portions between the toner and an object surface.

20. An image forming apparatus comprising:

a latent image carrier which carries a latent image, a charging unit configured to uniformly charge a surface of the latent image carrier, an exposing unit configured to expose the charged surface of the latent image carrier based on image data to write a latent electrostatic image on the latent image carrier, a developing unit configured to supply a toner to the latent electrostatic image formed on the surface of the latent image carrier to develop the image into a visible image, a transferring unit configured to transfer the visible image on the surface of the latent image carrier to a transfer material, and a fixing unit configured to fix the visible image on the transfer material, wherein the developing unit is an image developing apparatus in which a developer is carried and transported by a developer carrier to form a magnetic field in a position opposed to the latent image carrier and to develop a latent electrostatic image on the latent image carrier, wherein the developer is a toner which comprises a binder resin and a colorant, and wherein the toner has an average circularity of 0.95 or more and a ratio "D/S", of the total contact area of the toner "D" to the total projection area of the toner "S" being 15% to 40%, and the total contact area of the toner "D" is the total area of contact surface portions between the toner and an object surface.

21. A process for forming an image comprising:

charging a surface of a latent image carrier uniformly, exposing the charged surface of the latent image carrier based on image data to write a latent electrostatic image on the latent image carrier, supplying a toner to the latent electrostatic image formed on the surface of the latent image carrier to develop the image into a visible image, transferring the visible image on the surface of the latent image carrier to a transfer material, and fixing the visible image on the transfer material, wherein the toner comprises a binder resin, and a colorant, wherein the toner has an average circularity of 0.95 or more and a ratio "D/S", of the total contact area of the toner "D" to the total projection area of the toner "S" being 15% to 40%, and the total contact area of the toner "D" is the total area of contact surface portions between the toner and an object surface.

* * * * *